US009542924B2

(12) United States Patent
Kuo et al.

(10) Patent No.: US 9,542,924 B2
(45) Date of Patent: *Jan. 10, 2017

(54) APPARATUS, SYSTEM AND METHOD FOR NOISE CANCELLATION AND COMMUNICATION FOR INCUBATORS AND RELATED DEVICES

(71) Applicant: NORTHERN ILLINOIS RESEARCH FOUNDATION, Dekalb, IL (US)

(72) Inventors: Sen M. Kuo, Dekalb, IL (US); Lichuan Liu, Batavia, IL (US)

(73) Assignee: Northern Illinois Research Foundation, Dekalb, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/965,176

(22) Filed: Dec. 10, 2015

(65) Prior Publication Data

US 2016/0093281 A1 Mar. 31, 2016

Related U.S. Application Data

(63) Continuation of application No. 13/837,242, filed on Mar. 15, 2013, now Pat. No. 9,247,346, which is a (Continued)

(51) Int. Cl.
*G10K 11/16* (2006.01)
*G10K 11/178* (2006.01)
(Continued)

(52) U.S. Cl.
CPC ..... *G10K 11/178* (2013.01); *A47G 9/10* (2013.01); *G10K 11/1786* (2013.01);
(Continued)

(58) Field of Classification Search
CPC ..... G10K 11/1784; G10K 11/1786; G10K 11/178;G10K 11/116; G10K 2210/108; G10K 2210/30391; G10K 2210/1081; G10K 2210/00; G10K 2210/30231; G10K 2210/3045; G10K 2210/3216; G10K 2210/3228; G10K 2210/3026; G10K 2210/3023; G10L 2021/02165; G10L 2021/0208; G10L 21/0216; H04R 1/1083; H04R 29/00; H04R 3/002; H04R 3/005; H04R 2410/05
See application file for complete search history.

(56) References Cited

U.S. PATENT DOCUMENTS 3,342,285 A 9/1967 Robbins
3,998,209 A 12/1976 MacVaugh
(Continued)

FOREIGN PATENT DOCUMENTS

EP 0133195 2/1985
EP 2533239 12/2012
(Continued)

OTHER PUBLICATIONS

Beemanpally, "Multiple-Channel Hybrid Active Noise Control Systems with Infant Cry Detection for Infant Incubators," *UMI* No. 1494385 (2010).
(Continued)

*Primary Examiner* — Thang Tran
(74) *Attorney, Agent, or Firm* — Barnes & Thornburg LLP; Alice O. Martin

(57) ABSTRACT

Systems, apparatuses and methods for integrating adaptive noise cancellation (ANC) with communication features in an enclosure, such as an incubator, bed, and the like. Utilizing one or more error and reference microphones, a controller for a noise cancellation portion reduces noise within a quiet area of the enclosure. Voice communications are provided to allow external voice signals to be transmitted to the enclo-
(Continued)

sure with minimized interference with noise processing. Vocal communications from within the enclosure may be processed to determine certain characteristics/features of the vocal communications. Using these characteristics, certain emotive and/or physiological states may be identified.

16 Claims, 10 Drawing Sheets

Related U.S. Application Data continuation-in-part of application No. 13/673,005, filed on Nov. 9, 2012, which is a continuation of application No. 11/952,250, filed on Dec. 7, 2007, now Pat. No. 8,325,934.

(51) Int. Cl.
*H04R 3/00* (2006.01)
*A47G 9/10* (2006.01)
*A47G 9/00* (2006.01)

(52) U.S. Cl.
CPC ..... *H04R 3/002* (2013.01); *A47G 2009/006* (2013.01); *G10K 2210/1081* (2013.01); *G10K 2210/116* (2013.01)

(56) References Cited

U.S. PATENT DOCUMENTS

| | | | | |
|---|---|---|---|---|
| 4,038,499 | A | 7/1977 | Yeaple | |
| 4,941,478 | A | 7/1990 | Takeuchi et al. | |
| 4,985,925 | A | 1/1991 | Langberg et al. | |
| 5,133,017 | A | 7/1992 | Cain et al. | |
| 5,313,678 | A | 5/1994 | Redewill | |
| 5,327,496 | A * | 7/1994 | Russell et al. | 381/71.8 |
| 5,359,662 | A | 10/1994 | Yuan et al. | |
| 5,444,786 | A | 8/1995 | Raviv | |
| 5,473,684 | A | 12/1995 | Bartlett et al. | |
| 5,502,770 | A | 3/1996 | Kuo et al. | |
| 5,559,893 | A | 9/1996 | Krokstad et al. | |
| 5,581,833 | A | 12/1996 | Zenoff | |
| 5,602,928 | A * | 2/1997 | Eriksson et al. | 381/71.4 |
| 5,721,771 | A | 2/1998 | Higuchi | |
| 5,844,996 | A | 12/1998 | Enzmann et al. | |
| 5,940,519 | A | 8/1999 | Kuo | |
| 5,991,418 | A | 11/1999 | Kuo | |
| 6,097,823 | A | 8/2000 | Kuo | |
| 6,182,312 | B1 | 2/2001 | Walpin | |
| 6,198,828 | B1 | 3/2001 | Kuo | |
| 6,363,345 | B1 | 3/2002 | Marash et al. | |
| 6,418,227 | B1 | 7/2002 | Kuo | |
| 6,668,407 | B1 | 12/2003 | Reitzel | |
| 6,757,395 | B1 | 6/2004 | Fang | |
| 6,917,688 | B2 | 7/2005 | Yu et al. | |
| 7,000,273 | B2 | 2/2006 | Rivera-Wienhold et al. | |
| 7,020,288 | B1 * | 3/2006 | Ohashi | 381/71.4 |
| 7,526,428 | B2 | 4/2009 | Chamberlain | |
| 7,697,699 | B2 | 4/2010 | Ozawa | |
| 7,742,790 | B2 | 6/2010 | Konchitsky et al. | |
| 7,930,175 | B2 | 4/2011 | Haulick et al. | |
| 8,045,724 | B2 | 10/2011 | Sibbald | |
| 8,077,874 | B2 | 12/2011 | Sapiejewski | |
| 8,131,541 | B2 | 3/2012 | Yen et al. | |
| 8,155,334 | B2 | 4/2012 | Joho et al. | |
| 8,175,871 | B2 | 5/2012 | Wang et al. | |
| 8,184,822 | B2 | 5/2012 | Carreras et al. | |
| 8,204,242 | B2 | 6/2012 | Pan et al. | |
| 8,208,650 | B2 | 6/2012 | Joho et al. | |
| 8,255,209 | B2 | 8/2012 | Kong et al. | |
| 8,280,066 | B2 | 10/2012 | Joho et al. | |
| 8,280,069 | B2 | 10/2012 | Maeda et al. | |
| 8,320,591 | B1 | 11/2012 | Wurtz | |
| 8,335,318 | B2 | 12/2012 | Pan | |
| 8,401,205 | B2 | 3/2013 | Itabashi et al. | |
| 8,416,960 | B2 | 4/2013 | D'Agostino et al. | |
| 8,472,636 | B2 | 6/2013 | Sibbald | |
| 8,515,090 | B2 | 8/2013 | Morishima et al. | |
| 8,571,228 | B2 | 10/2013 | Sapiejewski et al. | |
| 8,718,291 | B2 * | 5/2014 | Alves et al. | 381/71.11 |
| 8,958,571 | B2 * | 2/2015 | Kwatra et al. | 381/94.1 |
| 9,082,389 | B2 * | 7/2015 | Nicholson et al. | |
| 9,247,346 | B2 * | 1/2016 | Kuo et al. | |
| 2001/0031052 | A1 | 10/2001 | Lock et al. | |
| 2002/0106092 | A1 | 8/2002 | Matsuo | |
| 2004/0234079 | A1 | 11/2004 | Schneider | |
| 2005/0201549 | A1 | 9/2005 | Dedieu | |
| 2007/0239225 | A1 | 10/2007 | Saringer | |
| 2009/0147965 | A1 | 6/2009 | Kuo | |
| 2009/0323976 | A1 | 12/2009 | Asada et al. | |
| 2010/0022280 | A1 | 1/2010 | Schrage | |
| 2010/0061564 | A1 * | 3/2010 | Clemow et al. | 381/71.6 |
| 2010/0278355 | A1 | 11/2010 | Yamkovoy | |
| 2011/0007907 | A1 | 1/2011 | Park et al. | |
| 2011/0026724 | A1 * | 2/2011 | Doclo | 381/71.8 |
| 2011/0158419 | A1 * | 6/2011 | Theverapperuma | G10K 11/178 381/71.1 |
| 2011/0182436 | A1 | 7/2011 | Murgia et al. | |
| 2011/0206214 | A1 | 8/2011 | Christoph et al. | |
| 2011/0235813 | A1 | 9/2011 | Gauger, Jr. | |
| 2011/0299695 | A1 | 12/2011 | Nicholson | |
| 2011/0305345 | A1 | 12/2011 | Bouchard et al. | |
| 2012/0014532 | A1 * | 1/2012 | Kimura | 381/71.6 |
| 2012/0020489 | A1 | 1/2012 | Narita | |
| 2012/0051548 | A1 | 3/2012 | Visser et al. | |
| 2012/0057720 | A1 | 3/2012 | Van Leest | |
| 2012/0057722 | A1 | 3/2012 | Osako et al. | |
| 2012/0128176 | A1 | 5/2012 | Acero et al. | |
| 2012/0155666 | A1 | 6/2012 | Nair | |
| 2012/0155667 | A1 | 6/2012 | Nair | |
| 2012/0162471 | A1 | 6/2012 | Sekiya et al. | |
| 2012/0163614 | A1 | 6/2012 | Asada et al. | |
| 2012/0163623 | A1 | 6/2012 | Konchitsky | |
| 2012/0170766 | A1 | 7/2012 | Alves et al. | |
| 2012/0197638 | A1 | 8/2012 | Li et al. | |
| 2012/0250873 | A1 | 10/2012 | Bakalos et al. | |
| 2012/0275620 | A1 | 11/2012 | Matsuo | |
| 2012/0278070 | A1 | 11/2012 | Herve et al. | |
| 2012/0308022 | A1 | 12/2012 | Ookuri et al. | |
| 2013/0022213 | A1 | 1/2013 | Alcock | |
| 2013/0028435 | A1 | 1/2013 | Christoph | |
| 2013/0108068 | A1 | 5/2013 | Poulsen et al. | |
| 2013/0121498 | A1 | 5/2013 | Giesbrecht | |
| 2013/0129106 | A1 | 5/2013 | Sapiejewski | |
| 2013/0142349 | A1 | 6/2013 | Liu et al. | |
| 2013/0177163 | A1 | 7/2013 | Hsiao | |
| 2013/0216060 | A1 | 8/2013 | Narayan et al. | |
| 2013/0252675 | A1 | 9/2013 | Nicholson | |
| 2014/0003614 | A1 * | 1/2014 | Levitov | G10K 11/002 381/71.7 |
| 2014/0072135 | A1 | 3/2014 | Bajic et al. | |
| 2014/0086425 | A1 | 3/2014 | Jensen et al. | |
| 2014/0169579 | A1 * | 6/2014 | Azmi | 381/71.6 |

FOREIGN PATENT DOCUMENTS

| | | |
|---|---|---|
| EP | 2642481 | 9/2013 |
| JP | H08-083080 | 3/1996 |
| JP | 08140807 | 6/1996 |
| JP | 2006293145 | 10/2006 |
| JP | 2007089814 | 4/2007 |
| WO | WO 2007/038922 | 4/2007 |

OTHER PUBLICATIONS

Chang et al., "Active Noise Cancellation Without Secondary Path Identification by Using an Adaptive Genetic Algorithm," *IEEE Trans. on Instrumentation and Measurement*, 59(9): 2315-2327 (2010).

Das et al., "New Block Filtered-X LMS Algorithms for Active Noise Control Systems," *IET Signal Processing*, 1(2): 73-81 (2007).

(56) References Cited

OTHER PUBLICATIONS

Gan et al., "Adaptive Feedback Active Noise Control Headsets: Implementation, Evaluation and Its Extensions" *IEEE Trans. on Consumer Electronics*, 51(3): 975-982 (2005).
Gan et al., "An Integrated Audio and Active Noise Control Headsets," *IEEE Trans. on Consumer Electronics*, 48(2): 242-247 (2002).
Gan et al., "Audio Projection: Directional Sound and Its Application in Immersive Communication," *IEEE Signal Processing Magazine*, 29(1): 43-57 (2011).
Gan et al., "Embedded Signal Processing with the Micro Signal Architecture," John Wiley & Sons, Hoboken, NJ, pp. v-xix (2007).
Gan et al., "Teaching DSP Software Development: From Design to Fixed-Point Implementations," *IEEE Trans. on Education*, 49(1): 122-131 (2006).
Gan et al., "Transition from Simulink to MATLAB in Real-Time Digital Signal Processing Education," *International Journal on Engineering Education*, 21(3): 587-595 (2005).
Gan et al., "Virtual Bass for Home Entertainment, Multimedia PC, Game Station and Portable Audio Systems," *IEEE Trans. on Consumer Electronics*, 47(4): 787-794 (2001).
Greenwood et al. "Implementation of the Fractal-Based Random-Iterated Function System Decoding on the AT&T DSP32C," Chapter 4 in Progress in Computer Graphics, Edited by C. Sabharwal and G. Zobrist, pp. 127-163, Ablex Publishing Co., Norwood, NJ, 1992.
Gujjula, "Real-Time Audio-Integrated Active Noise Control System for Infant Incubators," *UMI* No. 1460212 (2008).
Gupta et al., "Active Vibration Control of a Structure by Implementing Filtered-X LMS Algorithm for Active Vibration Control," *Noise Control Engineering Journal*, 54(6): 396-405 (2006).
Gupta et al., "Digital Implementation of Active Vibration Control of a Structure," *Journal of Low Frequency Noise, Vibration and Active Control*, 26(2): 135-141 (2007).
Jeon et al., "A Narrowband Active Noise Control System with Frequency Corrector," *IEEE Trans. Audio, Speech and Language Processing*, 19(4): 990-1002 (2011).
Jeon et al., "Analysis of Frequency Mismatch in Narrowband Active Noise Control," *IEEE Trans. Audio, Speech and Language Processing*, 18(6): 1632-1642 (2010).
Kong et al., "Analysis of Asymmetric Out-of-Band Overshoot in Narrowband Active Noise Control Systems," *IEEE Trans. on Speech Audio Processing*, 7(5): 587-591 (1999).
Kong et al., "Multiple Channel Hybrid Active Noise Control Systems," *IEEE Trans. on Control Systems Technology*, 6(6): 719-729 (1998).
Kong et al., "Study of Causality Constraint on Feed-forward Active Noise Control Systems," *IEEE Trans. on Circuits and Systems*, 46(2): 183-186 (1999).
Kuo et al, "Active Noise Control Systems—Algorithms and DSP Implementations," John Wiley & Sons, New York, NY (1996).
Kuo et al., "A Secondary Path Modeling Technique for Active Noise Control Systems," *IEEE Trans. on Speech and Audio Processing*, 5(4): 374-377 (1997).
Kuo et al., "Acoustic Noise and Echo Cancellation Microphone System for Videoconferencing," *IEEE Trans. on Consumer Electronics*, 41(4): 1150-1158 (1995).
Kuo et al., "Acoustical Mechanisms and Performance of Various Active Duct Noise Control Systems," *Applied Acoustics*, 41(1): 81-91 (1994).
Kuo et al., "Active Noise Control System for Headphone Applications," *IEEE Trans. on Control Systems Technology*, 14(2): 331-335 (2006).
Kuo et al., "Active Noise Control System with Parallel On-Line Error-Path Modeling Algorithm," *Noise Control Engineering Journal*, Institute of Noise Control Engineering, 39(3): 119-127 (1992).
Kuo et al., "Active Noise Control," Chapter 49 in Springer Handbook of Speech Processing and Speech Communications, Edited by J. Benesty, Y. Huang, and M. Sondhi, pp. 1001-1017, Berlin Heidelberg: Springer-Verlag, 2008.
Kuo et al., "Active Noise Control: A Tutorial Review," *Proceedings of the IEEE*, 87(6): 943-973 (1999).
Kuo et al., "Active Snore Noise Control Systems," *Noise Control Engineering Journal*, 56(1): 16-24 (2008).
Kuo et al., "Adaptive Acoustic Echo Cancellation Microphone," *Journal of Acoustical Society of America*, 93(3): 1629-1636 (1993).
Kuo et al., "Adaptive Active Noise Control Systems," Chapter 2 in Digital Signal Processing Technology, Edited by P. Papamichalis and R. Kerwin, vol. CR57, pp. 23-49, SPIE Press, Bellingham, Washington, 1995.
Kuo et al., "Adaptive Algorithms and Experimental Verification of Feedback Active Noise Control Systems," *Noise Control Engineering Journal*, 42(2): 37-46 (1994).
Kuo et al., "Adaptive Noise and Acoustic Echo Cancellation Techniques for the Hands-Free Cellular Phone System," *Applied Signal Processing*, 1: 217-227 (1994).
Kuo et al., "An Acoustic Echo Canceler Adaptable During Double-Talk Periods Using Two Microphones," *Acoustics Letters*, 15(9): 175-178 (1992).
Kuo et al., "An Innovative Course Emphasizing Real-Time Digital Signal Processing Applications," *IEEE Trans. on Education*, 39(2): 109-113 (1996).
Kuo et al., "Analysis of Finite Length Acoustic Echo Cancellation System," *Speech Communication*, European Association for Signal Processing and European Speech Communication Association, 16(3): 255-260 (1995).
Kuo et al., "Applications of Adaptive Feedback Active Noise Control System," *IEEE Trans. on Control Systems Technology*, 11(2): 216-220 (2003).
Kuo et al., "Broadband Adaptive Noise Equalizer," *IEEE Signal Processing Letters*, 3(8): 234-235 (1996).
Kuo et al., "Convergence Analysis of Narrowband Active Noise Control Systems," *IEEE Trans. on Circuits and Systems—I: Analog and Digital System Processing*, 46(2): 220-223 (1999).
Kuo et al., "Design of Active Noise Control Systems with the TMS320 Family," Application Book, Texas Instruments, SPRA042 (1996).
Kuo et al., "Development and Analysis of an Adaptive Noise Equalizer," *IEEE Trans. on Speech and Audio Processing*, 3(3): 217-222 (1995).
Kuo et al., "Development and Analysis of Distributed Acoustic Echo Cancellation Microphone System," *Signal Processing*, European Association for Signal Processing, 37(3): 333-344 (1994).
Kuo et al., "Development and Application of Audio-Integrated Active Noise Control System for Infant Incubators," *Noise Control Engineering Journal*, 58(2): 163-175 (2010).
Kuo et al., "Development and Experiment of Narrowband Active Noise Equalizer," *Noise Control Engineering Journal*, 41(1): 281-288 (1993).
Kuo et al., "Development of Adaptive Algorithm for Active Sound Quality Control," *Journal of Sound and Vibration*, 299: 12-21 (2007).
Kuo et al., "Digital Hearing Aid with the Lapped Transform," *Digital Signal Processing*, 3(4): 228-239 (1993).
Kuo et al., "Digital Signal Processors: Architectures, Implementations, and Applications," Prentice Hall, Upper Saddle River, NJ (2005).
Kuo et al., "Distributed Acoustic Echo Cancellation System With Double-Talk Detector," *Journal of Acoustical Society of America*, 94(6): 3057-3060 (1993).
Kuo et al., "Dual-Channel Audio Equalization and Cross-Talk Cancellation for 3-D Sound Reproduction," *IEEE Trans. on Consumer Electronics*, 43(4): 1189-1196 (1997).
Kuo et al., "Effects of Frequency Separation in Periodic Active Noise Control Systems," *IEEE Trans. on Audio, Speech, and Language Processing*, 14(5): 1857-1866 (2006).
Kuo et al., "Frequency-Domain Delayless Active Sound Quality Control Algorithms," *Journal of Sound and Vibration*, 318: 715-724 (2008).
Kuo et al., "Frequency-Domain Periodic Active Noise Control and Equalization," *IEEE Trans. on Speech and Audio Processing*, 5(4): 348-358 (1997).

(56) References Cited

OTHER PUBLICATIONS

Kuo et al., "Implementation of Adaptive Filtering with the TMS320C25 or the TMS320C30," Chapter 7 in Digital Signal Processing Applications with the TMS320 Family, Edited by P. Papamichalis, vol. III, pp. 191-271, Prentice-Hall, Englewood Cliffs, NJ 1990.
Kuo et al., "Integrated Automotive Signal Processing and Audio System," *IEEE Trans. on Consumer Electronics*, 39(3): 522-532 (1993).
Kuo et al., "Integrated Frequency-Domain Digital Hearing Aid with the Lapped Transform," *Electronics Letters*. 28(23): 2117-2118 (1992).
Kuo et al., "Multipath Acoustic Echo Canceler with New PAP Structure and TW-LMS Algorithm," *Acoustic Letters*, 16(12): 270-273 (1993).
Kuo et al., "Multiple Reference Subband Adaptive Noise Canceler for Hands-free Cellular Phone Applications," *Journal of the Franklin Institute*, 333(B)(5): 669-686 (1996).
Kuo et al., "Multiple-Microphone Acoustic Echo Cancellation System with the Partial Adaptive Process," *Digital Signal Processing*, 3(1): 54-63 (1993).
Kuo et al., "Narrowband Active Noise Control Using Adaptive Delay Filter," *IEEE Signal Processing Letters*, 5(12): 309-311 (1998).
Kuo et al., "New Adaptive IIR Notch Filter and Its Application to Howling Control in Speakerphone System," *Electronics Letters*, 28(8): 764-766 (1992).
Kuo et al., "Nonlinear Adaptive Bilinear Filters for Active Noise Control Systems," *IEEE Trans. on Circuits and Systems, Part I*: Regular Papers, 52(3): 617-624 (2005).
Kuo et al., "On-Line Modeling and Feedback Compensation for Multiple-Channel Active Noise Control Systems," *Applied Signal Processing*, 1(2): 64-75 (1994).
Kuo et al., "Parallel Adaptive On-Line Error-Path Modeling Algorithm for Active Noise Control System," *Electronics Letters*, 28(4): 375-377 (1992).
Kuo et al., "Passband Disturbance Reduction in Periodic Active Noise Control System," *IEEE Trans. on Speech and Audio Processing*, 4(2): 96-103(1996).
Kuo et al., "Performance Analysis of Acoustic Echo Cancellation Microphone," *Acoustics Letters*, 16(7): 151-156 (1993).
Kuo et al., "Principle and Application of Adaptive Noise Equalizer," *IEEE Trans. on Circuits and Systems*, 41(7): 471-474 (1994).
Kuo et al., "Principle and Applications of Asymmetric Crosstalk-Resistant Adaptive Noise Canceler," *Journal of the Franklin Institute*, 337: 57-71 (2000).
Kuo et al., "Real-Time Digital Signal Processing: Implementations and Applications," John Wiley & Sons, West Sussex (2006).
Kuo et al., Real-Time Digital Signal Processing: Implementations, Applications, and Experiments with the TMS320C55x, John Wiley & Sons, Chichester, (2001).
Kuo et al., "Residual Noise Shaping Technique for Active Noise Control Systems," *Journal of Acoustical Society of America*, 95(3): 1665-1668 (1994).
Kuo et al., "Saturation Effects in Active Noise Control Systems," *IEEE Trans. on Circuits and Systems, Part 1: Regular Papers*, 51(6): 1163-1171 (2004).
Kuo et al., "Three-Stage Algorithm for Transformer Active Noise Control," *Applied Signal Processing*, 4(1): 27-38 (1997).
Lau et al., "Noise, Engineering Acoustics, Physical Acoustics, and Signal Processing in Acoustics: Active Noise Control I," *J. Acoust. Soc. Am*, 131(4): 3379-3381 (2012).
Lee et al., "Subband Adaptive Filtering: Theory and Implementation," John Wiley & Sons, West Sussex, (2009).
Liu et al. "Still in Womb: Intrauterine Acoustic Embedded Active Noise Control for Infant Incubators," *Advances in Acoustics and Vibration*, 2008(495317): 1-9 (2008).
Liu et al. "Multi-Channel Real Time Active Noise Control System for Infant Incubators," 31st *Annual International Conference of the IEEE EMBS*, 935-938 (2009).
Liu et al., "Active Noise Control for Motorcycle Helmet," *International Journal of Information and Communication Engineering*, 6(2): 103-108 (2010).
Liu et al., "An Audio Integrated Motorcycle Helmet," J. of *Low Frequency Noise, Vibration and Active Control*, 29(3): 161-170 (2010).
Liu et al., "Real-time Experiments of ANC Systems for Infant Incubators," *Noise Control Engineering Journal*, 60(1): 36-41 (2012).
Song et al., "A Robust Hybrid Feedback Active Noise Cancellation Headset," *IEEE Trans. on Speech and Audio Processing*, 13(4) 607-617 (2005).
Sun et al., "Active Narrowband Noise Control Systems Using Cascading Adaptive Filters," *IEEE Trans. on Audio, Speech, and Language Processing*, 15(2): 586-592 (2007).
Sun et al., "Adaptive Algorithm for Active Control of Impulsive Noise," *Journal of Sound and Vibration*, 291: 516-522 (2006).
Wang et al., "Integration of Bass Enhancement and Active Noise Control System in Automobile Cabin," *Advances in Acoustics and Vibration*, 2008: Article ID 869130 (2008).
Wu et al., "Teaching Challenge in Hands-on DSP Experiments for Night-School Students," *EURASIP Journal on Advances in Signal Processing*, 2008: Article ID 570896 (2008).
Yang et al., "Analysis of Narrowband Active Noise and Vibration Control Systems Using Parallel Adaptive Notch Filters," *Journal of Vibration and Control*, 14(7): 931-951 (2008).
Yu et al., "Active Noise Control for Infant Incubators," 31st *Annual International Conference of the IEEE EMBS*, 2531-2534 (2009).
International Search Report issued in PCT/US2008/085293 dated Jan. 29, 2009.
Supplementary European Search Report issued in EP08856447 dated Apr. 5, 2011.
Office Action issued in Japanese Patent App. No. 2010-537019 (Aug. 14, 2012).
Akhtar et al., "A New Structure for Feedforward Active Noise Control Systems With Improved Online Secondary Path Modeling," *Published in Speech and Audio Processing, IEEE Transactions*, vol. 13(5): 1082-1088 (Sep. 2005).
U.S. Appl. No. 13/673,005, filed Nov. 9, 2012.

* cited by examiner

APPARATUS, SYSTEM AND METHOD FOR NOISE CANCELLATION AND COMMUNICATION FOR INCUBATORS AND RELATED DEVICES

CROSS REFERENCE TO RELATED APPLICATIONS

This application is a continuation of U.S. patent application Ser. No. 13/837,242, titled "Apparatus, System and Method for Noise Cancellation and Communication For Incubators and Related Devices," filed on Apr. 23, 2013, which is a continuation-in part of U.S. patent application Ser. No. 13/673,005, titled "Encasement for Abating Environmental Noise, Hand-Free Communication and Non-Invasive Monitoring and Recording," filed on Nov. 9, 2012, which is a continuation of U.S. patent application Ser. No. 11/952,250 (now U.S. Pat. No. 8,325,934), titled "Electronic Pillow for Abating Snoring/Environmental Noises, Hands-Free Communications, And Non-Invasive Monitoring And Recording," filed Dec. 7, 2007. The disclosures set forth in the referenced applications are incorporated herein by reference in their entireties.

This invention was made with government support under grant number 7R03DC009673-04 awarded by the National Institutes of Health. The U. S. Government has certain rights in the invention.

BACKGROUND

The present disclosure relates to an electronic enclosure or encasement advantageously configured for an incubator or similar device, where excessive noise may be an issue. In particular, the present disclosure relates to an electronic enclosure including active noise control, and communication.

In U.S. patent application Ser. No. 11/952,250, referenced above and assigned to the assignee of the present application, techniques were disclosed for abating noise, such as snoring, in the vicinity of a human head by utilizing Adaptive Noise Control (ANC). More specifically, utilizing a multiple-channel feed-forward ANC system using adaptive FIR filters with an 1×2×2 FXLMS algorithm, a noise suppression system may be particularly effective at reducing snoring noises. While noise suppression is desirous for adult humans, special requirements may be needed in the cases of babies, infants, and other life forms that may have sensitivity to noise.

Newborn babies, and particularly premature, ill, and low birth weight infants are often placed in special units, such as neonatal intensive care units (NICUs) where they require specific environments for medical attention. Devices such as incubators have greatly increased the survival of very low birth weight and premature infants. However, high levels of noise in the NICU have been shown to result in numerous adverse health effects, including hearing loss, sleep disturbance and other forms of stress. At the same time, an important relationship during infancy is the attachment or bonding to a caregiver, such as a mother and/or father. This is due to the fact that this relationship may determine the biological and emotional 'template' for future relationships and well-being. It is generally known that healthy attachment to the caregiver through bonding experiences during infancy may provide a foundation for future healthy relationships. However, infants admitted to an NICU may lose such experiences in their earliest life due to limited interaction their parents due to noise and/or means of communication. Therefore, it is important to reduce noise level inside incubator and increase bonding opportunities for NICU babies and their parents. In addition, there are advantages for newborns inside the incubators to hear their mothers' voice which can help release the stress and improve language development. Communicating with NICU babies can also benefit the new mothers, such as, preventing postpartum depression, improving bonding, etc.

Regarding communication, it would be advantageous to provide "cues" to a caregiver based on an infant's cry, so that the infant may be understood, albeit on a rudimentary level. These cues may be advantageous for interpreting a likely condition of the infant via its vocal communication. Unlike adults, the airways of newborn infants are quite different from those of adults. The larynx in newborn infants is positioned close to the base of the skull. The high position of the larynx in the newborn is similar to its position in other animals and allows the newborn human to form a sealed airway from the nose to the lungs. The soft palate and epiglottis provide a "double seal," and liquids can flow around the relatively small larynx into the esophagus while air moves through the nose, through the larynx and trachea into the lungs. The anatomy of the upper airways in newborn infants is "matched" to a neural control system (newborn infants are obligated nose breathers). They normally will not breathe through their mouths even in instances where their noses may be blocked. The unique configuration of the vocal tract is the reason for the extremely nasalized cry of the infant.

From one perspective, the increasing alertness and decreasing crying as part of the sleep/wakefulness cycle suggests that there may be a balanced exchange between crying and attention. The change from sleep/cry to sleep/alert/cry necessitates the development of control mechanisms to modulate arousal. The infant must increase arousal more gradually, in smaller increments, to maintain states of attention for longer periods. Crying is a heightened state of arousal produced by nervous system excitation triggered by some form of perceived threat, such as hunger, pain, or sickness, or individual differences in thresholds for stimulation. Crying is modulated and developmentally facilitated by control mechanisms to enable the infant to maintain non-crying states.

The cry serves as the primary means of communication for infants. While it is possible for experts (experienced parents and child care specialists) to distinguish infant cries though training and experience, it is difficult for new parents and for inexperienced child care workers to interpret infant cries. Accordingly, techniques are needed to extract audio features from the infant cry so that different communicated states for an infant may be determined. Cry Translator™, a commercially available product known in the art, claims to be able to identify five distinct cries: hunger, sleep, discomfort, stress and boredom. An exemplary description of the product may be found in US Pat. Pub. No. 2008/0284409, titled "Signal Recognition Method With a Low-Cost Microcontroller," which is incorporated by reference herein. However, such configurations are less robust, provide limited information, are not necessarily suitable for NICU applications, and do not provide integrated noise reduction.

Accordingly, there is a need for infant voice analysis, as well as a need to coupled voice analysis with noise reduction. Using an infant's cry as a diagnostic tool may play an important role in determining infant voice communication, and for determining emotional, pathological and even medical conditions, such as SIDS, problems in developmental outcome and colic, medical problems in which early detection is possible only by invasive procedures such as chromosomal abnormalities, etc. Additionally, related techniques are needed for analyzing medical problems which may be readily identified, but would benefit from an improved ability to define prognosis (e.g., prognosis of long term developmental outcome in cases of prematurity and drug exposure).

SUMMARY

Under one exemplary embodiment, an enclosure, such as an incubator and the like, is disclosed comprising a noise cancellation portion, comprising a controller unit, configured to be operatively coupled to one or more error microphones and a reference sensing unit, wherein the controller unit processes signals received from one or more error microphones and reference sensing unit to reduce noise in an area within the enclose using one or more speakers. The enclosure includes a communications portion, comprising a sound analyzer and transmitter, wherein the communication portion is operatively coupled to the noise cancellation portion, said communications portion being configured to receive a voice signal from the enclosure and transform the voice signal to identify characteristics thereof.

In another exemplary embodiment, a method is disclosed for providing noise cancellation and communication within an enclosure, where the method includes the steps of processing signals, received from one or more error microphones and reference sensing unit, in a controller of a noise cancellation portion to reduce noise in an area within the enclose using one or more speakers; receiving internal voice signals from the enclosure; transforming the internal voice signals; and identifying characteristics of the voice signals based on the sound analyzing.

In a further exemplary embodiment, an enclosure is disclosed comprising a noise cancellation portion, comprising a controller unit, configured to be operatively coupled to one or more error microphones and a reference sensing unit, wherein the controller unit processes signals received from one or more error microphones and reference sensing unit to reduce noise in an area within the enclose using one or more speakers; a communications portion, comprising a sound analyzer and transmitter, wherein the communication portion is operatively coupled to the noise cancellation portion, said communications portion being configured to receive a voice signal from the enclosure and transform the voice signal to identify characteristics thereof; and a voice input apparatus operatively coupled to the noise cancellation portion, wherein the voice input apparatus is configured to receive external voice signals for reproduction on the one or more speakers.

In still further exemplary embodiments, the communications/signal recognition portion described above may be configured to transform the voice signal from a time domain to a frequency domain, wherein the transformation comprises at least one of linear predictive coding (LPC), Mel-frequency cepstral coefficients (MFCC), Bark-frequency cepstral coefficients (BFCC) and short-time zero crossing. The communications portion may be further configured to identify characteristics of the transformed voice signal using at least one of a Gaussian mixture model (GMM), hidden Markov model (HMM), and artificial neural network (ANN). In yet another exemplary embodiment, the enclosure described above may include a voice input operatively coupled to the noise cancellation portion, wherein the voice input is configured to receive external voice signals for reproduction on the one or more speakers, wherein the noise cancellation portion is configured to filter the external voice signals to minimize interference with signals received from one or more error microphones and reference sensing unit for reducing noise in the area within the enclose.

BRIEF DESCRIPTION OF THE DRAWINGS

Other advantages will be readily appreciated as the same becomes better understood by reference to the following detailed description when considered in connection with the accompanying drawings wherein.

DETAILED DESCRIPTION

As is known from U.S. patent application Ser. No. 11/952,250, noise reduction may be enabled in an electronic encasement comprising an encasement unit (e.g., pillow) in electrical connection with a controller unit and a reference sensing unit. The encasement unit may comprise at least one error microphone and at least one loudspeaker that are in electrical connection with the controller unit. Under a preferred embodiment, two error microphones may be used, positioned to be close to the ears of a subject (i.e., human). The error microphones may be configured to detect various signals or noises created by the user and relay these signals to the controller unit for processing. For example, the error microphones may be configured to detect speech sounds from the user when the electronic encasement is used as a hands-free communication device. The error microphones may also be configured to detect noises that the user hears, such as snoring or other environmental noises when the electronic encasement is used for ANC. A quiet zone created by ANC is centered at the error microphones. Accordingly, placing the error microphones inside the encasement below the user's ears, generally around a middle third of the encasement, may ensure that the user is close to the center of a quiet zone that has a higher degree of noise reduction.

Additionally, there may be one or more loudspeakers in the encasement, also preferably configured to be relatively close to the user's ears. More or fewer loudspeakers can be used depending on the desired function. Under a preferred embodiment, the loudspeakers are configured to produce various sounds. For example, the loudspeakers can produce speech sound when the electronic encasement acts as a hands-free communication device, and/or can produce anti-noise to abate any undesired noise. In another example, the loudspeakers can produce audio sound for entertainment or masking of residual noise. Preferably, the loudspeakers are small enough so as not to be noticeable. There are advantages to placing the loudspeakers relatively close to ears of a user, as the level of anti-noise generated by the loudspeakers is maximized compared to configurations where loudspeakers are placed in more remote locations. Lower noise levels also tend to reduce power consumption and reduce undesired acoustic feedback from the loudspeakers back to the reference sensing unit. The configurations described above may be equally applicable to enclosures, such as an incubator, as well as encasements. Also, it should be understood by those skilled in the art that use of the term "enclosure" does not necessarily mean that an area around noise cancellation is fully enclosed. Partial enclosures, partitions, walls, rails, dividers etc. are equally contemplated herein.

Figure 1:
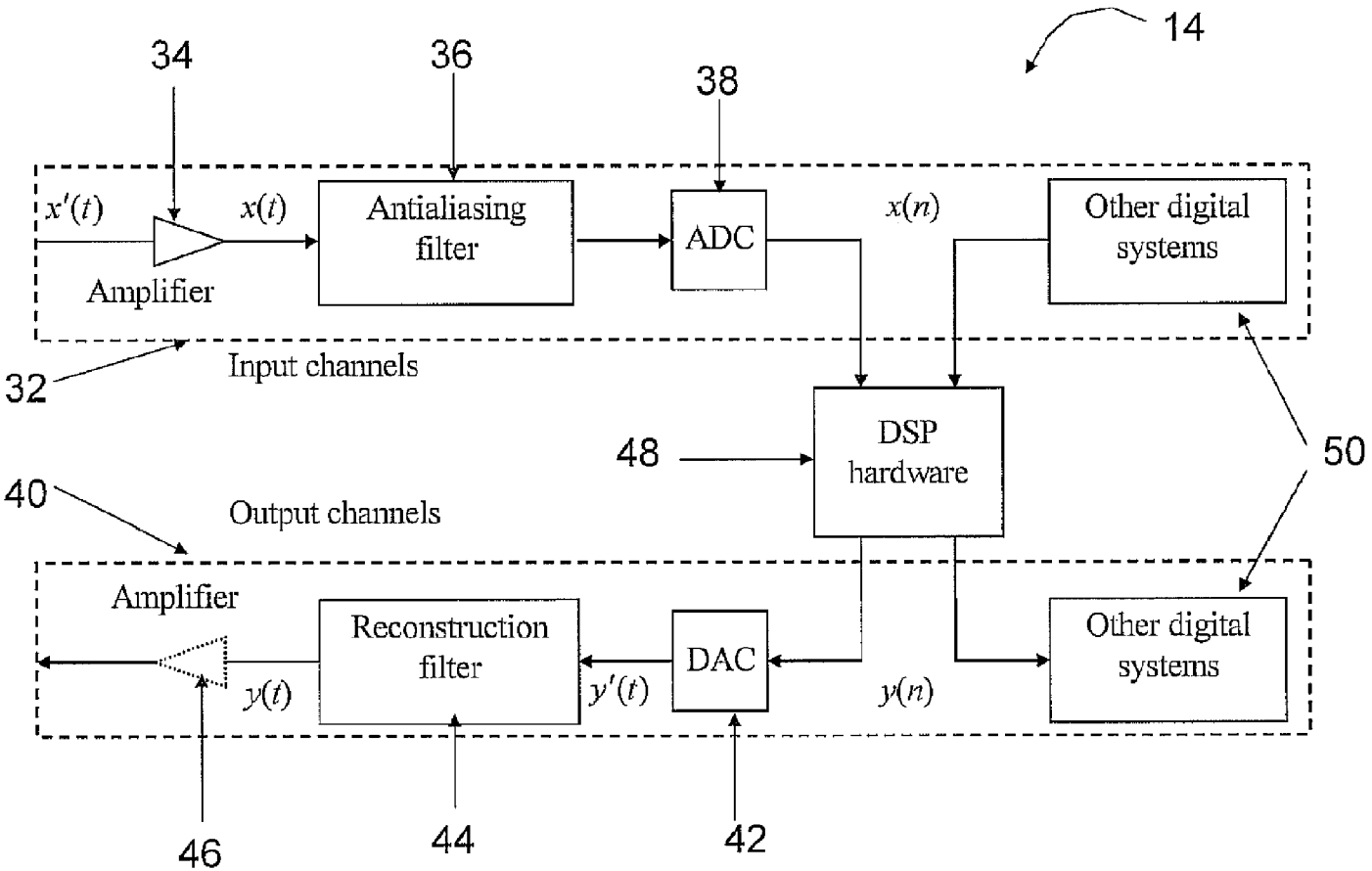
FIG. 1 is an exemplary block diagram of a controller unit under one embodiment.

Turning to FIG. 1, the controller unit 14 is a signal processing unit for sending and receiving signals as well as processing and analyzing signals. The controller unit 14 may include various processing components such as, but not limited to, a power supply, amplifiers, computer processor with memory, and input/output channels. The controller unit 14 can be contained within an enclosure, discussed in greater detail below (see FIG. 3), or it can be located outside of the enclosure. The controller unit 14 further includes a power source 24. The power source 24 can be AC such as a cord to plug into a wall socket or battery power such as a rechargeable battery pack. The embodiment of FIG. 1 preferably has at least one input channel 32, where the number of input channels 32 may be equal to the total number of error microphones in the enclosure and reference microphones in the reference sensing unit. The input channels 32 may be analog, and include signal conditioning circuitry, a preamplifier 34 with adequate gain, an anti-aliasing lowpass filter 36, and an analog-to-digital converter (ADC) 38. The input channels 32 receive signals (or noise) from the error microphones and the reference microphones.

In the embodiment of FIG. 1, there may be at least one output channel 40. The number of output channels 40 may be equal to the number of loudspeakers in the enclosure. The output channels 40 are preferably analog, and include a digital-to-analog converter (DAC) 42, smoothing (reconstruction) lowpass filter 44, and power amplifier 46 to drive the loudspeakers. The output channels 40 are configured to send a signal to the loudspeakers to make sound. Digital signal processing unit (DSP) 48 generally includes a processor with memory. The DSP receives signals from the input channels 32 and sends signals to the output channels 40. The DSP can also interface (i.e. input and output) with other digital systems 50, such as, but not limited to, audio players for entertainment and/or for creating environmental sounds (e.g., waves, rainfall), digital storage devices for sound recording, communication interfaces, or diagnostic equipment. DSP 48 may also includes one or more algorithms for operation of the electronic enclosure.

Generally speaking, the algorithm(s) may controls interactions between the error microphones, the loudspeakers, and reference microphones. Preferably, the algorithm(s) may be one of (a) multiple-channel broadband feed-forward active noise control for reducing noise, (b) adaptive acoustic echo cancellation, (c) signal detection to avoid recording silence periods and sound recognition for non-invasive detection, or (d) integration of active noise control and acoustic echo cancellation. Each of these algorithms are described more fully below. The DSP can also include other functions such as non-invasive monitoring using microphone signals and an alarm to alert or call caregivers for emergency situations.

The reference sensing unit includes at least one reference microphone. Preferably, the reference microphones are wireless for ease of placement, but they can also be wired. The reference microphones are used to detect the particular noise that is desired to be abated and are therefore placed near that sound. For example, if it is desired to abate noises in an enclosure from other rooms that can be heard through a door, the reference microphone may be placed directly on the door. The reference microphone may advantageously be placed near a noise source in order to minimize such noises near an enclosure. As will be described in further detail below, an enclosure equipped with noise-cancellation hardware may be used for a variety of methods in conjunction with the algorithms. For example, the enclosure can be used in a method of abating unwanted noise by detecting an unwanted noise with a reference microphone, analyzing the unwanted noise, producing an anti-noise corresponding to the unwanted noise in the enclosure, and abating the unwanted noise. Again, the reference microphone(s) may be placed wherever the noise to be abated is located. These reference microphones detect the unwanted noise and the error microphones 20 detect the unwanted noise levels at the enclosure's location, both reference microphones send signals to the input channels 32 of the controller unit 14, the signals are analyzed with an algorithm in the DSP, and signals are sent from the output channels 40 to the loudspeakers. The loudspeakers then produce an anti-noise (which may be produced by an anti-noise generator) that abates the unwanted noise. With this method, the algorithm of multiple-channel broadband feed-forward active noise control for reducing noise is used to control the enclosure.

The enclosure can also be used in a method of communication by sending and receiving sound waves through the enclosure in connection with a communication interface. The method operates essentially as described above; however, the error microphones are used to detect speech and the loudspeakers may broadcast vocal sounds. With this method, the algorithm of adaptive acoustic echo cancellation for communications may be used to control the enclosure, as described above, and this algorithm can be combined with active noise control as well. The configuration for the enclosure may be used in a method of recording and monitoring disorders, by recording noises produced by within the enclosure with microphones encased within a pillow. Again, this method operates essentially as described above; however, the error microphones are used to record sounds in the enclosure to diagnose sleep disorders. With this method, the algorithm of signal detection to avoid recording silence periods and sound recognition for non-invasive detection is used to control the enclosure.

The enclosure can further be used in a method of providing real-time response to emergencies by detecting a noise with a reference microphone in an enclosure, analyzing the noise, and providing real-time response to an emergency indicated by the analyzed noise. The method is performed essentially as described above. Certain noises detected are categorized as potential emergency situations, such as, but not limited to, the cessation of breathing, extremely heavy breathing, choking sounds, and cries for help. Detecting such a noise prompts the performance of real-time response action, such as producing a noise with the loudspeakers, or by notifying caregivers or emergency responders of the emergency. Notification can occur in conjunction with the communications features of the enclosure, i.e. by sending a message over telephone lines, wireless signal or by any other warning signals sent to the caregivers. The enclosure may also be used in a method of playing audio sound by playing audio sound through the loudspeakers of the enclosure. The audio sound can be any, such as soothing music or nature sounds. This method can also be used to abate unwanted noise, as the audio sound masks environmental noises. Also, by locating the loudspeakers inside the enclosure, lower volume can be used to play the audio sound.

Figure 2:
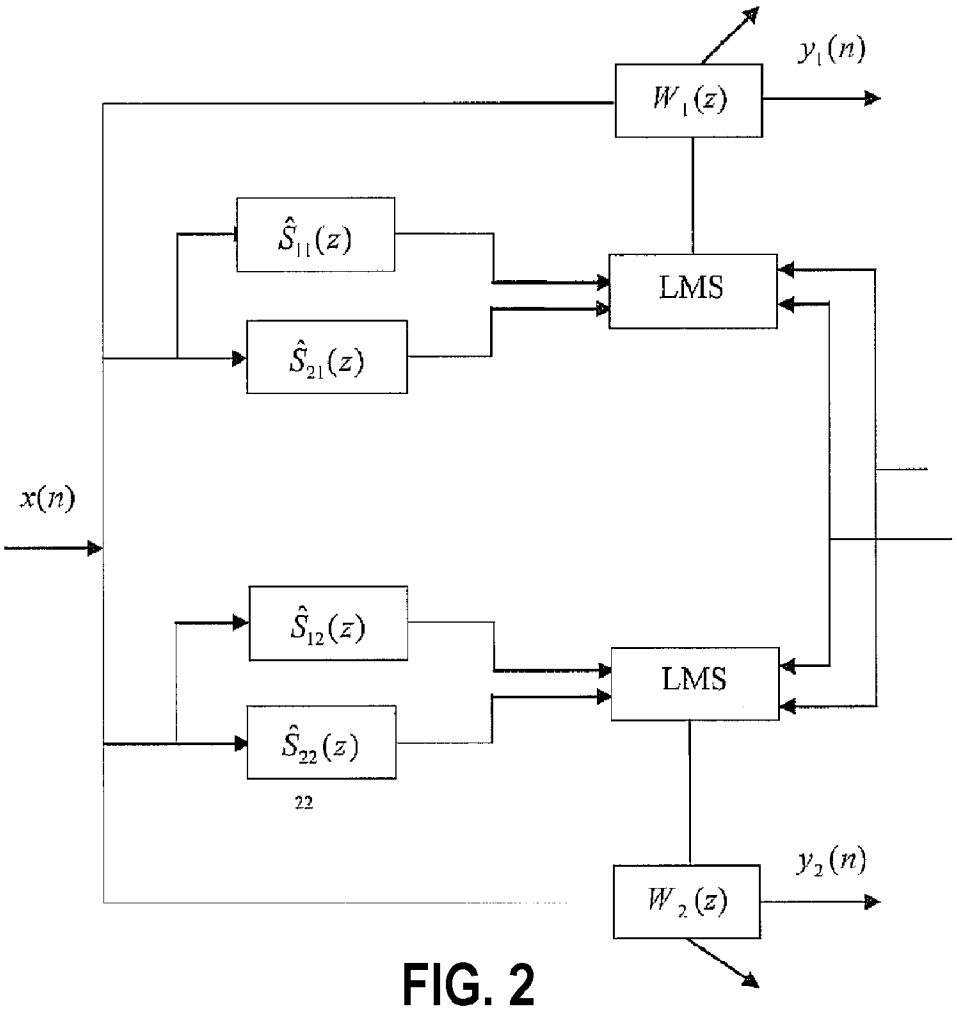
FIG. 2 is a functional diagram of an exemplary multiple-channel feed-forward ANC system using adaptive FIR filters with the 1×2×2 FXLMS algorithm under one embodiment.

Turning to FIG. 2, an exemplary illustration is provided for performing Multiple-Channel Broadband Feed-forward Active Noise Control for an enclosure. In this example a multiple-channel feed-forward ANC system is configured with one reference microphone, two loudspeakers and two error microphones independently. The multiple-channel ANC system uses the adaptive FIR filters with the 1×2×2 FXLMS algorithm. The reference signal x(n) is sensed by reference microphones in the reference sensing unit. Two error microphones (located in the pillow unit) obtain the error signals $e_1(n)$ and $e_2(n)$, and the system is thus able to form two individual quiet zones centered at the error microphones that are close to the ears of sleeper. The ANC algorithm used two adaptive filters $W_1(z)$ and $W_2(z)$ to generate two anti-snores $y_1(n)$ and $y_2(n)$ to drive the two independent loudspeakers (also embedded inside the pillow unit). $\hat{S}_{11}(z)$, $\hat{S}_{12}(z)$, $\hat{S}_{21}(z)$, and $\hat{S}_{22}(z)$ are the estimates of the secondary path transfer functions using both on-line or offline secondary path modeling techniques.

The 1×2×2 FXLMS algorithm may be summarized as follows:

$$y_1(n)=w_1^T(n)x(n), i=1,2 \tag{1}$$

$$w_1(n+1)=w_1(n)+\mu_1[e_1(n)x(n)*\hat{s}_{11}(n)+e_2(n)x(n)*\hat{s}_{21}(n)] \tag{2}$$

$$w_2(n+1)=w_2(n)+\mu_2[e_1(n)x(n)*\hat{s}_{12}(n)+e_2(n)x(n)*\hat{s}_{22}(n)] \tag{3}$$

where $w_1(n)$ and $w_2(n)$ are coefficient vectors and $\mu_1$ and $\mu_2$ are the step sizes of the adaptive filters $W_1(z)$ and $W_2(z)$, respectively, and $\hat{s}_{11}(n)$, $\hat{s}_{21}(n)$, $\hat{s}_{12}(n)$ and $\hat{s}_{22}(n)$ are the impulse responses of the secondary path estimates $\hat{S}_{11}(z)$, $\hat{S}_{12}(z)$, $\hat{S}_{21}(z)$, and $\hat{S}_{22}(z)$ respectively.

Configurations directed to adaptive acoustic echo cancellation and integration of active noise control with acoustic echo cancellation are disclosed in U.S. patent application Ser. No. 11/952,250, and will not be repeated here for the sake of brevity. However, it should be understood by those skilled in the art that the techniques described therein may be applicable to the present disclosure, depending on the needs of the enclosure designer.

Figure 3:
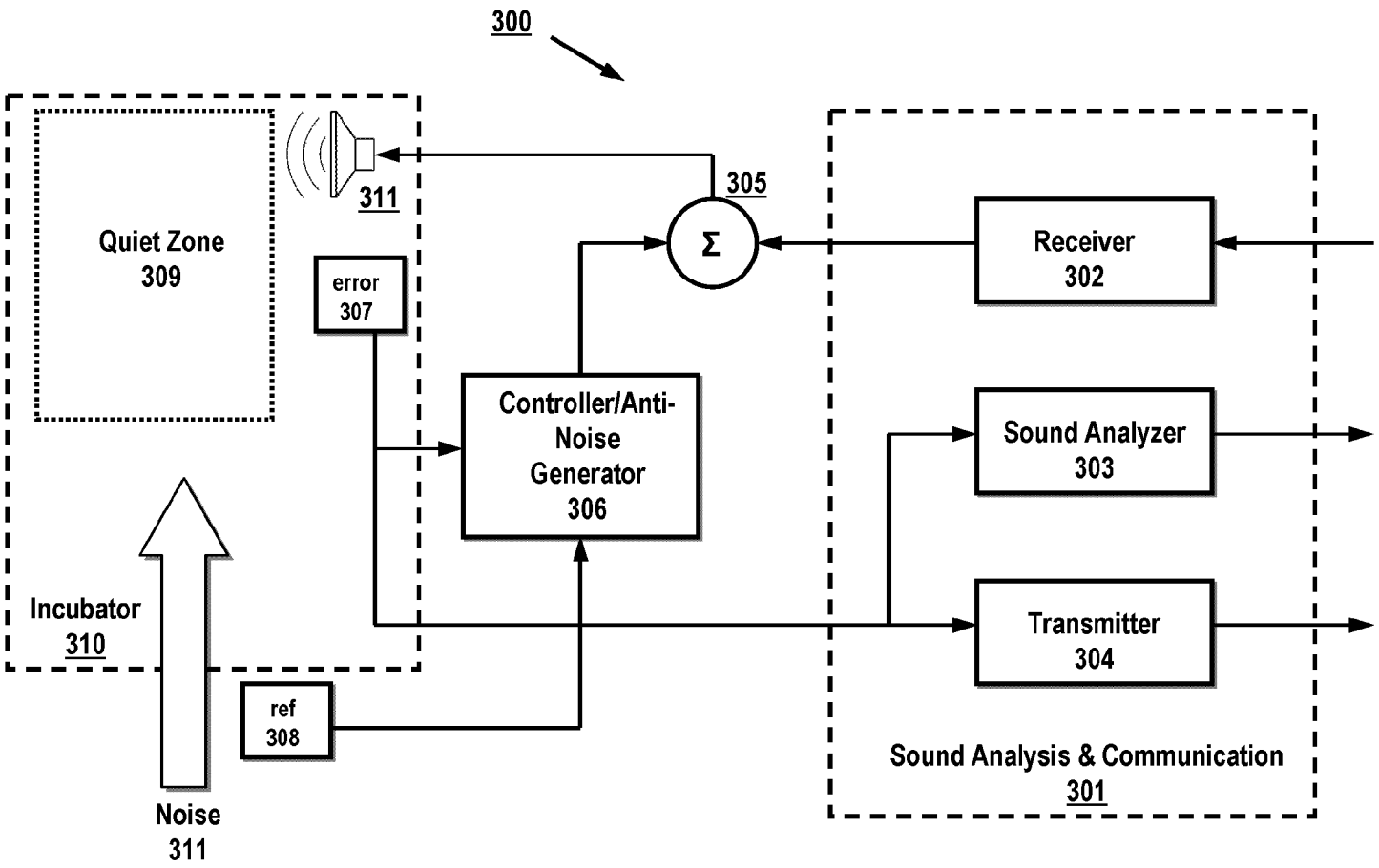
FIG. 3 illustrates a wireless communication integrated ANC system 300, combining wireless communication and ANC algorithms for an enclosure under one embodiment.

Turning to FIG. 3, one example of a wireless communication integrated ANC system 300, combining wireless communication and ANC algorithms for an incubator enclosure is disclosed. Here, the ANC may be configured to cancel unwanted noises and the wireless communication can provide two way communications between parents and infants. The embodiment of FIG. 3 is preferably comprises a sound analysis and communications portion 301, including (1) a ANC portion (302, 305, 306, 311) for reducing external noise for the infant incubator, and (2) a wireless communication portion (303, 304) integrated with ANC system to provide communication between infants and their parents or caregivers. In order to comfort infants, the desired speech signal, such as, mother's voice may be picked up in receiver 302, processed and played to infant through the loudspeaker 311 inside the incubator. The infant audio signals such as crying, breathing, and cooing, will be picked up by the error microphone inside the incubator 310, processed, and played externally.

The noise abatement of system 300 may be viewed as comprising four modules or units including (1) a noise control acoustic unit, (2) a electronic controller unit, (3) a reference sensors unit, and (4) a communication unit. The noise control acoustic unit includes one or more anti-noise loudspeakers 311, at least partially operated by anti-noise generator 306, and microphones (error microphone 307, and reference microphone 308), operatively coupled to an electronic controller which may be part of unit 306 and/or 301. The controller may include a power supply and amplifiers, a processor with memory, and input/output channels for performing signal processing tasks. The reference sensing unit may comprise wired or wireless microphones (308), which can be placed outside the incubator 310 for abating outside noise 311, or alternately on windows for abating environmental noises, or doors for reducing noise from other rooms, or on other known noise sources. The wireless communication unit may include wireless or wired transmitter and receivers (302, 304) for communication purposes.

Figure 4:
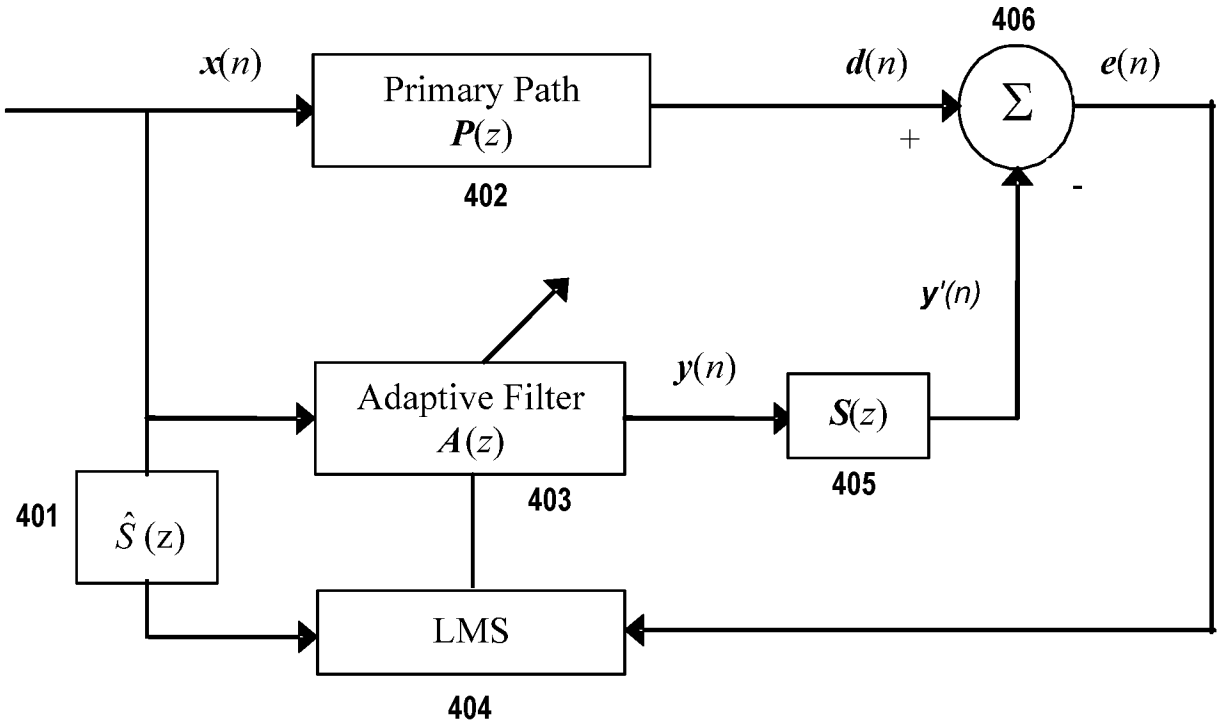
FIG. 4 illustrates a general multi-channel ANC system suitable for the embodiment of FIG. 3 under one embodiment.

A general multi-channel ANC system suitable for the embodiment of FIG. 3 is illustrated in FIG. 4, where the embodiment is configured with the assumption that there are J reference sensors (microphones), K secondary sources and M error sensors (microphones). The J channels reference signals may be expressed as:

$$x(n)=[x_1^T(n)x_2^T(n)\ldots x_J^T(n)]^T$$

with $x_j(n)$ is the jth-channel reference of signal of length L. The secondary sources have K channels, or $$y(n)=[y_1(n)y_2(n)\ldots y_K(n)]^T,$$

where $y_k(n)$ is the signal of kth output channel at time n. The error signals have M channels, or $$e(n)=[e_1(n)e_2(n)\ldots e_M(n)]^T$$

where $e_m(n)$ is the error signal of mth error channel at time n. Both the primary noise d(n) and the cancelling noise d'(n) are vectors with M elements at the locations of M error sensors Primary paths impulse responses (402) can be expressed by a matrix as $$P(n)=\begin{bmatrix} p_{11}(n) & p_{12}(n) & \cdots & p_{1,J}(n) \\ p_{21}(n) & p_{22}(n) & \cdots & p_{2,J}(n) \\ \vdots & \vdots & \ddots & \vdots \\ p_{M1}(n) & p_{M1}(n) & \vdots & p_{MJ}(n) \end{bmatrix}$$

where $p_{mj}$ (n) is the impulse response function from the jth reference sensor to the mth error sensor. The matrix of secondary path impulse response functions (405) may be given by $$S(n)=\begin{bmatrix} s_{11}(n) & s_{12}(n) & \dots & s_{1K}(n) \\ s_{21}(n) & s_{22}(n) & \dots & s_{2K}(n) \\ \vdots & \vdots & \ddots & \vdots \\ s_{M1}(n) & s_{M2}(n) & \dots & s_{MK}(n) \end{bmatrix}$$

where $s_{mk}(n)$ is the impulse response function from the kth secondary source to the mth error sensor. An estimate of S(n), denoted as $\hat{S}(n)$ (401) can be similarly defined.

Matrix A(n) may comprise feed-forward adaptive finite impulse response (FIR) filters impulse response functions (403), which has J inputs, K outputs, and filter order L, $$A(n)=[A_1^T(n)A_2^T(n)\ \dots\ A_K^T(n)]^T, \text{ where}$$

$$A_k(n)=[A_{k,1}^T(n)A_{k,2}^T(n)\ \dots\ A_{k,J}^T(n)]^T, k=1,2,\dots,K$$

is the weight vector of the kth feedforward FIR adaptive filter with J input signals defined as $$A_{k,j}(n)=[a_{k,j,1}(n)a_{k,j,2}(n)\ \dots\ a_{k,j,L}(n)]^T,$$

which is the feed-forward FIR weight vector form jth input to kth output.

The secondary sources may be driven by the summation (406) of the feed-forward and feedback filters outputs. That is $$y_k(n)=\sum_{j=1}^{J} x_j^T(n)A_{k,j}(n)=x^T(n)A_k(n)$$

The error signal vector measured by M sensors is $$\begin{aligned} e(n) &= d(n)+y'(n) \\ &= d(n)+S(n)*[X^T(n)A(n)] \end{aligned}$$

where d(n) is the primary noise vector and y'(n) is the canceling signal vector at the error sensors.

The filter coefficients are iteratively updated to minimize a defined criterion. The sum of the mean square errors may be used as the cost function defined as $$\xi(n)=\sum_{m=1}^{M} E\{e_m^2(n)\}=e^T(n)e(n)$$

The least mean square (LMS) adaptive algorithm (404) uses a steepest descent approach to adjust the coefficients of the feed-forward and feedback adaptive FIR filters in order to minimize (n) as follows:

$$A(n+1)=A(n)-\mu_a X'(n)e(n)$$

where $\mu_a$ and $\mu_b$ are the step sizes for feedforward and feedback ANC systems, respectively. In another embodiment, different values may be used to improve convergence speed:

$$X'(n)=[S(n)*X^T(n)]^T=$$

-continued $$\left[\begin{bmatrix} \hat{s}_{11}(n) & \hat{s}_{12}(n) & \dots & \hat{s}_{1K}(n) \\ \hat{s}_{21}(n) & \hat{s}_{22}(n) & \dots & \hat{s}_{2K}(n) \\ \vdots & \vdots & \ddots & \vdots \\ \hat{s}_{M1}(n) & \hat{s}_{M2}(n) & \dots & \hat{s}_{MK}(n) \end{bmatrix} * \begin{bmatrix} x(n) & 0 & \dots & 0 \\ 0 & x(n) & \dots & 0 \\ \vdots & \vdots & \ddots & 0 \\ 0 & 0 & \dots & x(n) \end{bmatrix}\right]^T$$

that is $$=\begin{bmatrix} x'_{11}(n) & x'_{12}(n) & \dots & x'_{1M}(n) \\ x'_{21}(n) & x'_{22}(n) & \dots & x'_{2M}(n) \\ \vdots & \vdots & \ddots & \vdots \\ x'_{K1}(n) & x'_{K2}(n) & \dots & x'_{KM}(n) \end{bmatrix}$$

and $$\begin{aligned} x'_{km}(n) &= s_{mk(n)}*x(n) \\ &= [\, s_{mk(n)}*x_1^T(n) \quad s_{mk(n)}*x_2^T(n) \quad \dots \quad s_{mk(n)}*x_J^T(n)\,] \\ &= [\, x'^T_{km1}(n) \quad x'^T_{km2}(n) \quad \dots \quad x'^T_{kmJ}(n)\,] \end{aligned}$$

The updated adaptive filter's coefficients can be expressed, $$A_k(n+1)=A_k(n)-\mu\sum_{m=1}^{M} x'_{km}(n)e_m(n)$$

and it can be further expended as $$\begin{aligned} A_{k,j}(n+1) &= A_{k,j}(n)-\mu\sum_{m=1}^{M} x'_{km}(n)e_m(n) \\ &= A_{k,j}(n)-\mu\sum_{m=1}^{M} [s_{mk(n)}*x_j(n)]e_m(n) \end{aligned}$$

In addition to noise reduction, the embodiment of FIG. 3 may be advantageously configured to provide a level of communication for an infant. In order to comfort infants, a desired audio signal, such as a mother's voice is picked up by receiver 302, processed, and reproduced to an infant through the anti-noise loudspeaker 311 inside incubator 310. In turn, infant audio signals such as crying, breathing, and cooing, will be picked up by the error microphone 307 inside incubator 310, processed (303, 304), and reproduced via a separate speaker (not shown), where an emotional or physiological state may also be displayed via visual or audio indicia (e.g., screen, lights, automated voice, etc.). This configuration may allow parents outside the NICU to communicate to and listen from the infant inside the incubator, thus improves bonding for parents without visiting NICU with limited time periods.

Under one embodiment, direct-sequence spread spectrum (DS/SS) techniques may be used to conduct wireless communication. In another embodiment; orthogonal frequency-division multiplexing (OFDM) or ultra-wideband (UWB) techniques may be used. For DS/SS communications, each information symbol may be spread using a length-L spreading code. That is, $$d(k)=v(n)c(n,l) \tag{7}$$

where v(n) is the symbol-rate information bearing voice signal, and c(n, l) is the binary spreading sequence of the nth symbol. In one embodiment, c(n) is used instead of c(n, l) for simplicity. The received chip-rate matched filtered and sampled data sequence can be expressed as the product of the chip-rate sequence d(k) and its spatial signature h, $$p(k)=d(k)h \tag{8}$$

Within a symbol interval, after chip-rate processing received data becomes $$r=p+w \tag{9}$$

where the L by 1 vector p contains signal of interest, and w is the white noise

Figure 5:
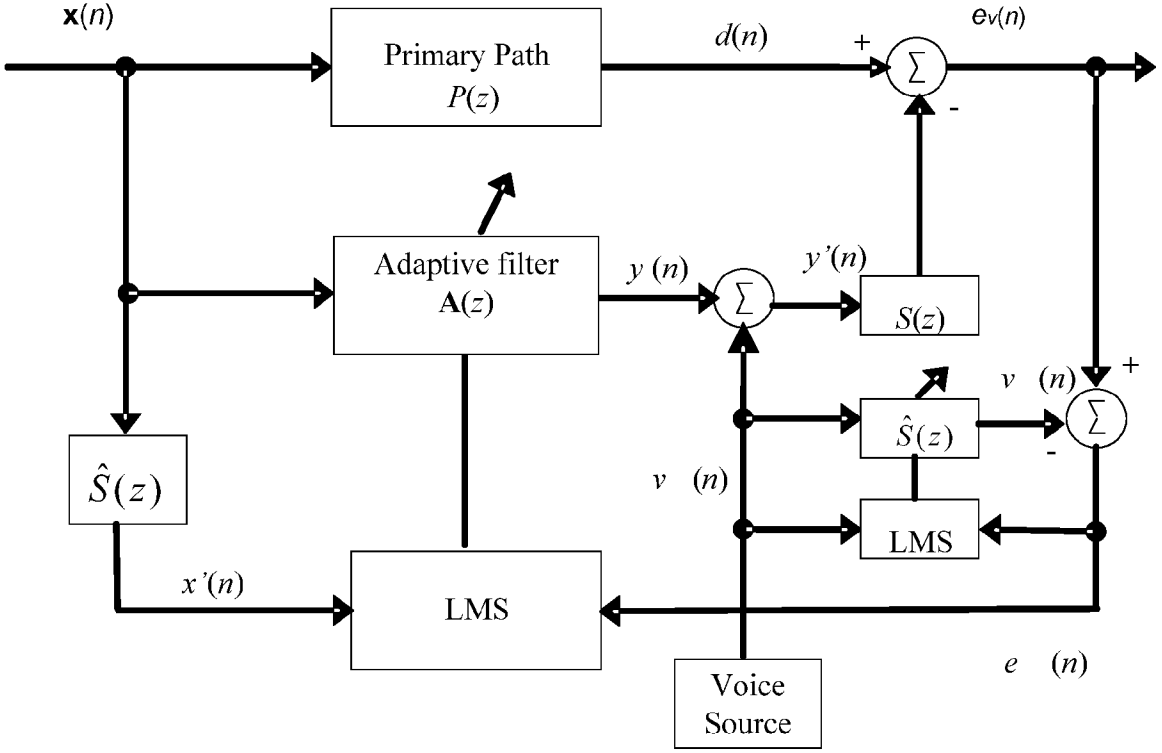
FIG. 5 illustrates a general multi-channel ANC system combined with the external voice communication for an enclosure under one exemplary embodiment.

An embodiment for combining/integrating ANC with the aforementioned communications is illustrated in FIG. 5. Here, voice signal v(n) is added to the adaptive filter output y(n), then the mixed signal propagates through the secondary path S(z) to generate anti-noise y'(n). At the quiet zone (309), the primary noise d(n) is canceled by the anti-noise, resulting in the error signal $e_v(n)$ sensed by the error microphone, which contains the residual noise and the audio signal. To avoid the interference of the audio on the performance of ANC, the audio signal v(n) is filtered through the secondary-path estimate $\hat{S}(z)$ and subtracted from $e_v(n)$ to get the true error signal e(n) for updating the adaptive filter A(z).

Using a z-domain notations, $E_v(z)$ can be expressed as $$Ev(z)=D(z)-S(z)[Y(z)+V(z)], \tag{10}$$

Where the actual error signal E(z) may be expressed as $$E(z) = Ev(z) + \hat{S}(z)V(z) = D(z) - S(z)[Y(z) + V(z)] + \hat{S}(z)V(z). \tag{11}$$

Assuming that the perfect secondary-path model is available, i.e., $\hat{S}(z)=S(z)$, we have $$E(z)=D(z)-S(z)Y(z). \tag{12}$$

This shows that the true error signal is obtained in the integrated ANC system, where the voice signal is removed from the signal ev(n) picked up by the error microphone. Therefore, the audio components won't degrade the performance of the noise control filter A(z). Thus, some of the advantages of the integrated ANC system are that (i) it provides audio comfort signal from the wireless communication devices, (ii) it masks residual noise after noise cancellation, (iii) it eliminates the interference of audio on the performance of ANC system, and (iv) it integrates with the existing ANC's audio hardware such as amplifiers and loudspeakers for saving overall system cost.

Figure 6A:
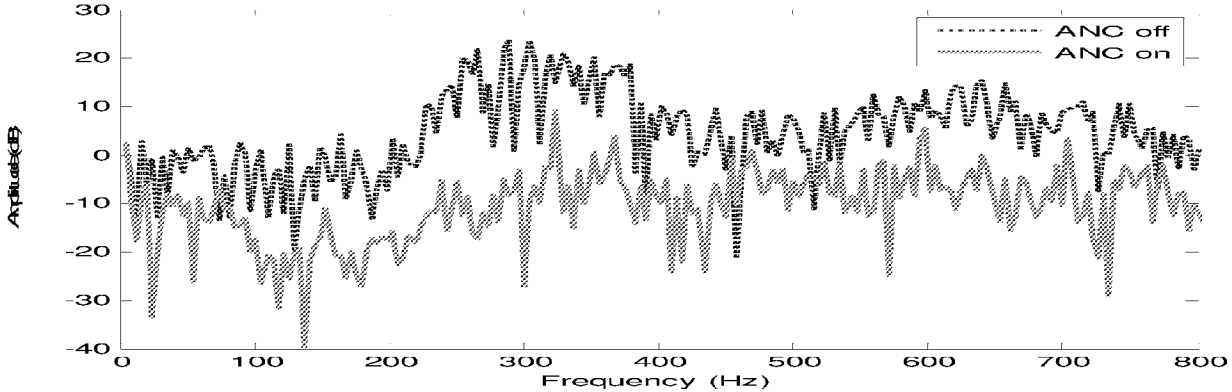
FIGS. 6A and 6B illustrate spectra of error signals and noise cancellation before and after ANC for error microphones under one exemplary embodiment.
Figure 6B:
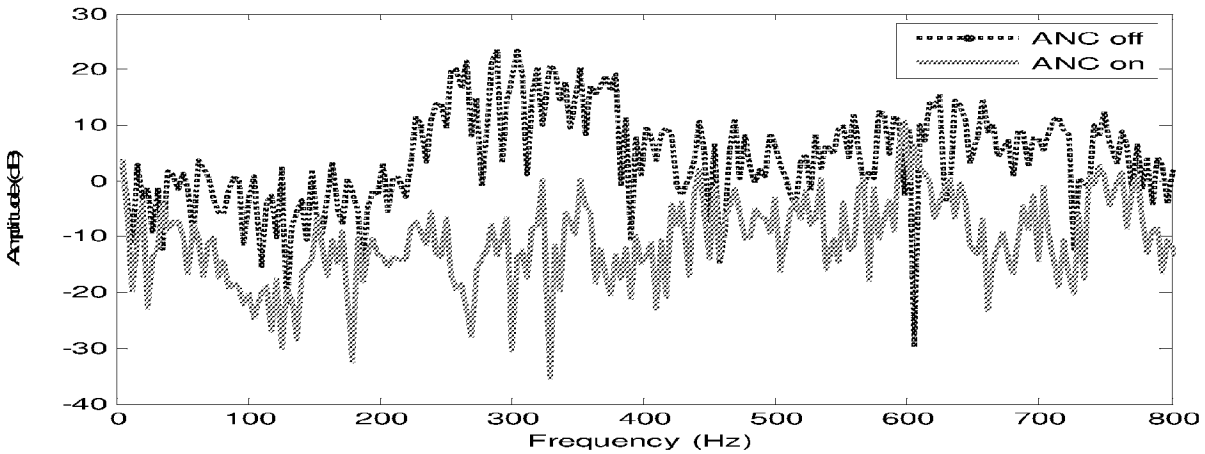
Figure 7:
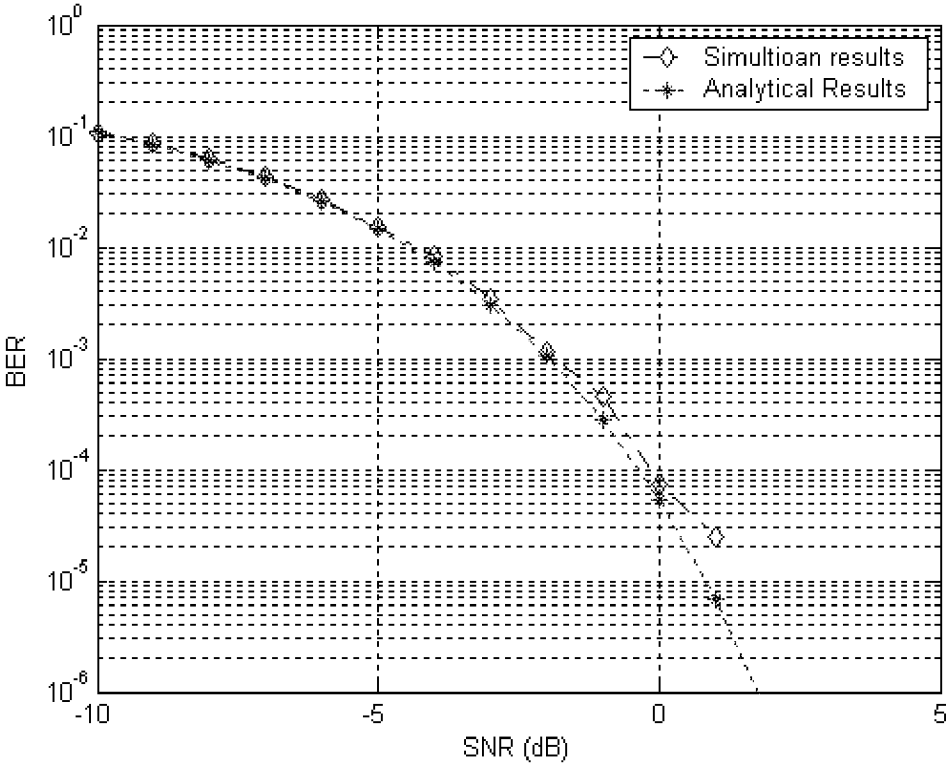
FIG. 7 is a chart illustrating a relationship between a bit error rate (BER) and signal-to-noise ratios (SNR) under one exemplary embodiment.

A multiple-channel ANC system such as the one illustrated in FIG. 5 was evaluated with J=1, K=2 and M=2 when the primary noise is recorded incubator noise. The spectra of error signals before and after ANC at the error microphones are illustrated in FIGS. 6A and 6B. It can be seen that there is a meaningful reduction of the recorded incubator noises over the entire frequency range of interest. Average noise cancellation was found to be 30 dB at a first error microphone (FIG. 6A), and 35 dB at a second error microphone (FIG. 6B). For the wireless communication system, a single user configuration was simulated and analyzed with Rayleigh channel and the DS/SS signal uses Gold code of length L=15. FIG. 7 illustrates the BER vs. SNR results, where it can be seen that the results shows a good match with the analytical result.

In addition to the audio signals being transmitted from the infant's incubator, sound analysis (303) can be performed on the emanating audio signal (e.g., cry, coo, etc.) in order to characterize a voice signal. Although it does not have a conventional language form, a baby cry (and similar voice communication) may be considered a kind of speech signal, the character of which is non-stationary and time varying. Under one embodiment, short time analysis and threshold method are used to detect the pair of boundary points-start point and end point of each cry word. Feature extraction of each baby cry word is important in classification and recognition, and numerous algorithms can be used to extract features, such as: linear predictive coding (LPC), Mel-frequency cepstral coefficients (MFCC), Bark-frequency cepstral coefficients (BFCC), and some other frequency extraction of stationary features. In this exemplary embodiment, 10 order Mel-frequency cepstral coefficient (MFCC-10) having 10 coefficients is used as a feature pattern for each cry word. It should be understood by those skilled in the art that other numbers of coefficients may be used as well.

Once features are extracted, different statistical methods can be utilized to effect baby cry cause recognition, such as Gaussian Mixture Model (GMM), Hidden Markov Models (HMM), and Artificial Neural Network (ANN). In one embodiment discussed herein, ANN is utilized for baby cry causes recognition. ANN imitates how human brain neurons work to perform certain task, and it can be considered as a parallel processing network system with a large number of connections. ANN can learn a rule from examples and generalize relationships between inputs and outputs, or in other words, find patterns of data. A Learning Vector Quantization (LVQ) model can be used to implement the classification of multi-class issue. The objective of using LVQ ANN model for baby-cry-cause recognition is to develop a plurality (e.g., 3) feature patterns which represent cluster centroids of each baby-cry-cause: draw attention cry, wet diaper cry, and hungry cry, as an example.

With regards to baby cry classification and recognition techniques, baby cry word boundary points detection may be advantageously employed. A speech signal of comprehensible length is typically a non-stationary signal that cannot be processed by stationary signal processing methods. However, during a limited short-time interval, the speech waveform can be considered stationary. Because of the physical limitation of human vocal cord vibration, in practical applications 10-30 milliseconds (ms) duration interval may used to complete short-time speech analysis, although other intervals may be used as well. A speech signal may be thought of as comprising a voiced speech component with vocal cord vibration and an unvoiced speech component without vocal cord vibration. A cry word can be defined as the speech waveform duration between a start point and an end point of a voiced speech component. Voiced speech and unvoiced speech have different short-time characteristics, which can be used to detect the boundary points of baby cry words.

Short-time energy (STE) is defined as the average of the square of the sample values in a suitable window, which may be expressed as:

$$E(n) = \frac{1}{N}\sum_{m=0}^{N-1} [w(m)x(n-m)]^2$$

where w(m) is the window coefficient correspond with signal sample, and N is window length. The most obvious difference is that voiced speech has higher short-time energy (STE), but unvoiced speech has lower STE. In one embodiment, a Hamming window may be chosen as it minimizes the maximum side lobe in the frequency domain and can be described as:

$$w(m) = .54 - .46\cos\left(\frac{2\pi m}{N-1}\right)$$

As previously mentioned, short-time processing of speech may preferably take place during segments between 10-30 ms in length. For a signals of 8 kHz sampling frequency, a window of 128 samples (~16 ms) may be used. STE estimation is useful as a speech detector because there is a noticeable difference between the average energy between voiced and unvoiced speech, and between speech and silence. Accordingly, this technique may be paired with short-time zero crossing for a robust detection scheme.

Short-time zero crossing (STZC) may be defined as the rate at which the signal changes sign. It can be mathematically described as:

$$Z(n) = \frac{1}{N}\sum_{m=0}^{N-1} |\text{sign}(x(n-m)) - \text{sign}(x(n-m-1))|,$$

where $\text{sign}(x(m)) = 1,$ if $x(m) \geq 0 = -1$, otherwise

STZC estimation is useful as a speech detector because there are noticeable fewer zero crossings in voiced speech as compared with unvoiced speech. STZC is advantageous in that it is capable of predicting cry signal start and endpoints. Significant short-time zero crossing effectively describes the envelope of a non-silent signal and combined with short-time energy, can effectively track instances of potentially voiced signals that are the signals of interest for analysis.

There are some false positive cries that may be detected, as not all signals bounded by the STZC boundary contain cries. Large STZC envelopes with low energy tended to contain cry precursors such as whimpers and breathing events. Not all signals with non-negligible STE contained cries as well. Infant coughing events may be bounded by a STZC boundary and contained a noticeable STE. In order to consistently pick up desired cry events, a desired cry may be defined as a voiced segment of sufficiently long duration. Two quantifiable threshold conditions that are needed to be met to constitute a desired voiced may be:

1) Normalized energy>0.05 (To eliminate non-voiced artifacts such as breathing/whimpering and to supersede cry precursors)
2) Signal envelope period>0.1 seconds (To eliminate impulsive voiced artifacts such as coughing)

Returning back to STE processing, as baby cry signals may be down sampled from 44.1 kHz to 7350 Hz, a window length N may be chosen as 128, which translates to a 17.4 ms short-time interval. In order to detect the boundary points of cry words by setting a proper threshold value, the STE must be normalized into range from 0 to 1 by dividing the maximum STE value of whole duration. To eliminate unvoiced artifact of low STE or very short duration high energy impulse, two quantifiable thresholds should be set to detect the cry word boundary points. Those two threshold conditions are:

(1) Normalized STE>0.05 (to eliminate unvoiced artifact such as whimper, breathing), and
(2) Interval between start point and end point of a cry word>0.14 second (at least about 1024 signal samples to eliminate impulsive voiced artifact such as coughing)

Those voiced speech component start points and end points can be detected by normalized STE threshold, and some short duration false cry words detected can be eliminated by interval threshold.

Short-time segment of speech can be considered stationary. Stationary feature extraction techniques can be compartmentalized into either cepstral based (taking the Fourier transform of the decibel spectrum) or linear predictor (determining the current speech sample based on a linear combination of prior samples) based algorithms. In sound processing, the mel-frequency cepstrum (MFC) is a representation of the short-term power spectrum of a sound, based on a linear cosine transform of a log power spectrum on a nonlinear mel-scale of frequency. In practical application of speech recognition, Mel-frequency cepstral coefficients (MFCC) is considered the best characteristic parameter which is closest to the non-linear low and high frequency perception of human ear.

In sound processing, the mel frequency cepstrum is a representation of the short-time power spectrum of a sound based on a linear cosine transform of a log spectrum on a non-linear mel scale of frequency. The mel scale is a perceptual scale of pitches. It is based upon the human perception of the separation on a scale of pitches. The reference of the mel scale with standard frequency may be defined by 1000 Hz tone 40 dB above the listeners threshold and is equivalent to a pitch of 1000 mels. What the mel frequency cepstrum provides is a tool that describes the tonal characteristics of a signal that is warped such that it better matches human perceptual hearing of tones (or pitches). The conversion between mel (m) and Hertz (f) can be described as $$m = 2595\log_{10}\left[\frac{f}{700} + 1\right].$$

The mel frequency cepstrum may be obtained through the following steps. A short-time Fourier transform of the signal is taken in order to obtain the quasi-stationary short-time power spectrum F(f)=F{f(t)}. The frequency portion of the spectrum is then mapped to the mel scale perceptual filter bank with the equation above using 18 triangle band pass filters equally spaced on the mel range of frequency F(m). These triangle band pass filters smooth the magnitude spectrum such that the harmonics are flattened in order to obtain the envelope of the spectrum with harmonics. This indicates that the pitch of a speech signal is generally not present in MFCC. As a result, a recognition system will behave more or less the same when the input utterances are of the same timbre but with different tones/pitch. This also serves to reduce the size of the features involved, making the classification simpler.

The log of this filtered spectrum is taken and then the Fourier transform of the log spectrum squared results in the power cepstrum of the signal, or $$|F\{\log(|F(m)|^2)\}|^2.$$

At this point, the discrete cosine transform (DCT)

$$X_k = \sum_{n=0}^{N-1} x_n \cos\left[\frac{\pi}{N}\left(N + \frac{1}{2}\right)k\right]$$

of the power cepstrum is taken to obtain the MFCC, which may be used to measure audio signal similarity. The DCT coefficients are retained as they represent the power amplitudes of the mel frequency cepstrum. To keep the codebook length similar, an $n^{th}$ (e.g., $10^{th}$) order MFCC may be obtained. However, in addition to the MFCC, and in order to have a more similar basis in algorithm for comparison in feature classification, the MFLPCC may be used as well. The power cepstrum may possesses the same sampling rate as the signal, so the MFLPCC is obtained by performing an LPC algorithm on the power cepstrum in 128 sample frames. The MFLPCC encodes the cepstrum waveform in a more compact fashion that may make it more suitable for a baby cry classification scheme.

Figure 8:
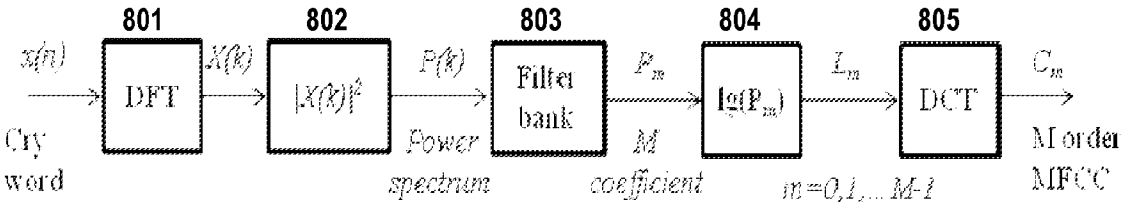
FIG. 8 illustrates an exemplary MFCC feature extraction procedure under one exemplary embodiment.

An exemplary MFCC feature extract procedure is illustrated in FIG. 8. The procedure shown in the figure can be implemented step by steps as follows:

Step 1. Take discrete Fourier transform (DFT) of signal 801, where N points DFT can be expressed as follows:

$$X(k) = \sum_{n=0}^{N-1} x(n)e^{-\frac{j2\pi nk}{N}}$$

Step 2. Square each spectrum amplitude value 802 to get power spectrum:

$$P(k)=|X(k)|^2$$

Figure 9:
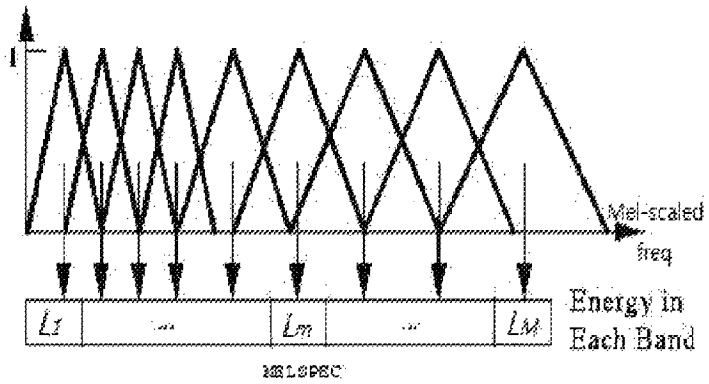
FIG. 9 illustrates one effect of convoluting a power spectrum with a Mel scaled triangular filter bank under one embodiment.

Step 3. Convolute the power spectrum P(k) with a Mel scaled triangular filter bank 803, which is shown in FIG. 9.

Again, for this example, the number of subband filters is 10, and P(k) are binned onto the mel scaled frequency using 10 overlapped triangular filter. Here binning means that each P(k) is multiplied by the corresponding filter gain and the results accumulated as energy in each band. The relationship between frequency and Mel scale can be expressed as follows:

$$Mel(f) = 259.5\log_{10}\left(1 + \frac{f}{700}\right)$$

Figure 10:
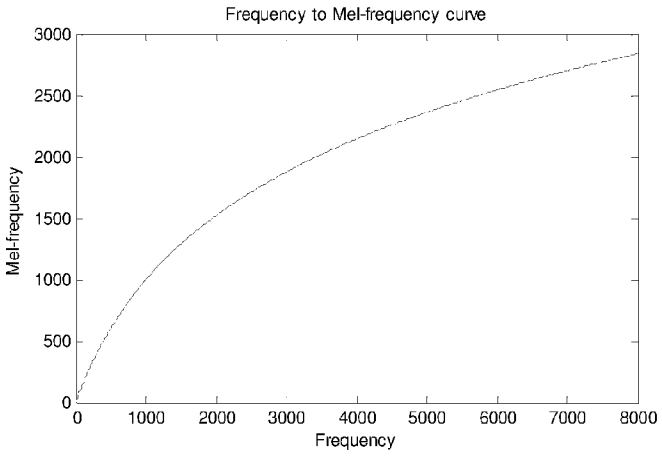
FIG. 10 illustrates an exemplary nonlinear Mel frequency curve under one embodiment.

The resulting nonlinear Mel frequency curve is illustrated in FIG. 10.

Step 4. Take logarithm 804:

$$L_m = \log\left(\sum_{k=0}^{N-1} |X(k)|^2 H_m(k)\right), 0 \le m < M$$

where N is the number of DFT points, and M=10.

Step 5. Take discrete cosine transform (DCT) 805 to get MFCC:

$$C_m = \sum_{n=0}^{M-1} L_m \cos\left(\frac{\pi m(n+0.5)}{M}\right), 0 \le m < M$$

where MFCC order M is 10.

In one embodiment, a Linear vector quantization (LVQ) neural network model is used. A self organizing neural network has the ability to assess the input patterns presented to the network, organize itself to learn from the collective set of inputs, and categorize them into groups of similar patterns. In general, self-organized learning involves the frequent modification of the network's synaptic weights in response to a set of input patterns. LVQ is such a self organizing neural network model that can be used to classify the different baby cry causes. LVQ may be considered a kind of feed-forward ANN, and is advantageously used in areas of pattern recognition or optimization.

Different baby-cry-causes may be assumed to have different feature patterns; as such, the objective of classification is to determine a general feature pattern that is a kind of MFCC "codebook" from example training feature data for a specific baby cry cause, such as "draw attention" cry, "need to change wet diaper" cry, "hungry" cry, etc. Subsequently the unknown cause baby cry may be recognized by finding out the shortest distance between the input unknown cry word MFCC-10 feature vector and every class "codebook" respectively.

A LVQ algorithm may be used to complete a baby-cry-cause classification, where a plurality of baby-cry-causes may be taken into consideration (e.g., draw attention, diaper change needed, hungry, etc.). Thus, an exemplary LVQ neural network would have a plurality (e.g., 3) output classes which would corresponding to the main baby-cry-causes:

Class 1: Draw attention cry

Class 2: Diaper change needed cry

Class 3: Hungry cry

Figure 11:
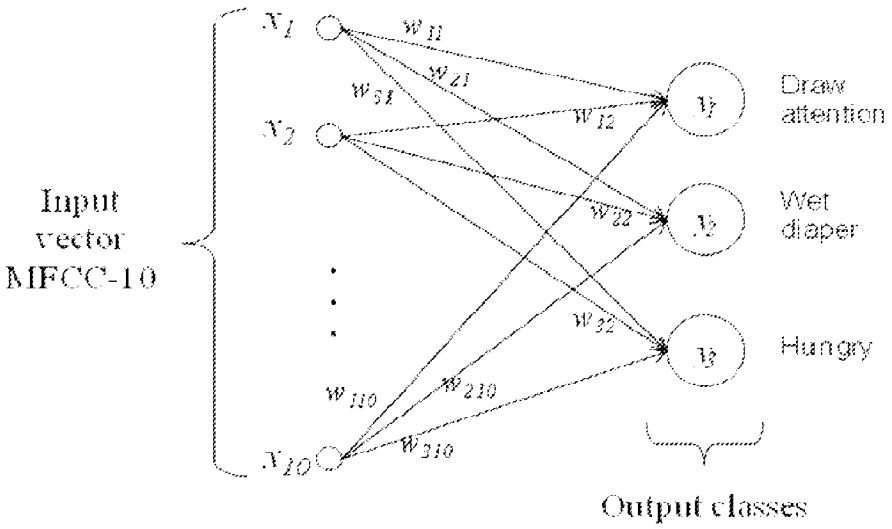
FIG. 11 illustrates an exemplary linear vector quantization (LVQ) neural network model Architecture under one embodiment.

An exemplary LVQ architecture is shown in FIG. 11. The input vector in this example is a 10-dimension cry word MFCC-10 feature which can be expressed as:

$$X=[x_1x_2 \ldots x_{10}]^T$$

where all the weights in response to the input vector and output classes can be expressed as:

$$W = [\,W_1 \quad W_2 \quad W_3\,] = \begin{bmatrix} w_{11} & \ldots & w_{31} \\ \vdots & \ddots & \vdots \\ w_{110} & \ldots & w_{310} \end{bmatrix}$$

where $W_1=[w_{1\ 1}w_{1\ 2} \ldots w_{1\ 10}]^T$ represents the pattern "codebook" of draw attention cry, $W_2=[w_{2\ 1}w_{2\ 2} \ldots w_{2\ 10}]^T$ represents the pattern "codebook" of diaper change needed cry, and $W_3=[w_{3\ 1}\ w_{3\ 2} \ldots w_{3\ 10}]^T$ represents the pattern "codebook" of hungry cry.

The exemplary LVQ neural network model may be trained using the follows steps:

Step 1. Initialize all weight vectors $W_1(0)$, $W_2(0)$, and $W_3(0)$ choosing a cry word MFCC-10 from each baby cry cause class. Initialize the adaptive learning step size $$\mu(k) = \frac{\mu(0)}{k}, \mu(0) = 0, 1, \quad \text{and} \quad k = 1, 2, \ldots, N,$$

and k=1, 2, . . . N, where N is the number of iteration.

Step 2. For each training input vector X, perform step 3 and step 4:

Step 3. Determine the weight vector index j such that the Euclidean distance $$\|X(k)-W_j(k)\|^2$$

is minimal, and

Step 4. Update the appropriate weight vector $W_j(k)$ as follows:

$$\begin{cases} W_j(k+1) = W_j(k) + \mu(k)[X(k) - W_j(k)], & C_{W_j(k)} = C_{X(k)} \\ W_j(k+1) = W_j(k) - \mu(k)[X(k) - W_j(k)], & C_{W_j(k)} \neq C_{X(k)} \end{cases}$$

Where $C_{X(k)}$ is the known class index of input X at time k, for example, if input X(k) is MFCC-10 of a hungry cry word, $C_{X(k)}=3$. Preferably, only $W_j$ is updated and the updating rule depends on whether the class index of input pattern equals to the index j obtained in Step 4.

Step 5. Repeat step 2, 3, 4, until k=N.

After finishing training, $W_1(N)$, $W_2(N)$, $W_3(N)$ may be considered the pattern "codebook" for three baby-cry-causes exemplified above, respectively.

Figure 12A:
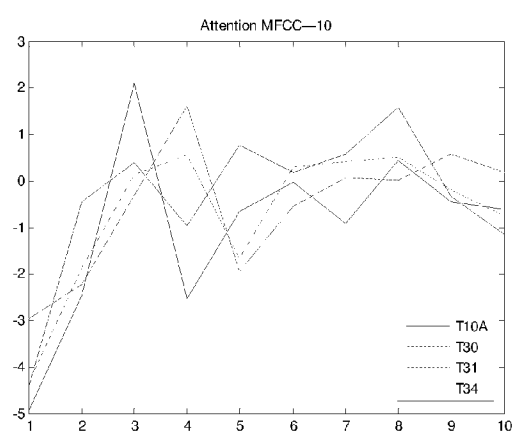
FIGS. 12A-D illustrate various voice feature identification characteristics under one exemplary embodiment.
Figure 12B:
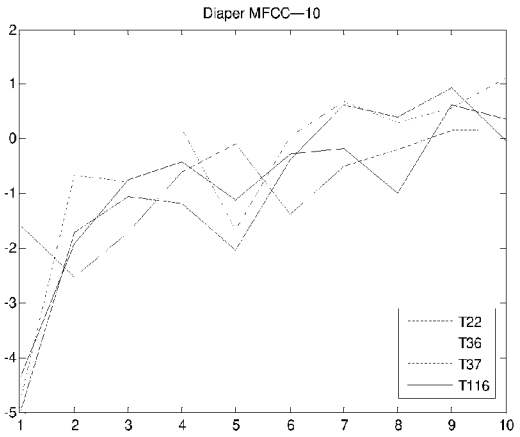
Figure 12C:
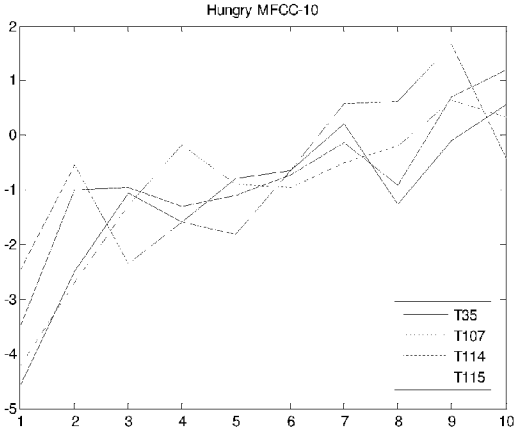
Figure 12D:
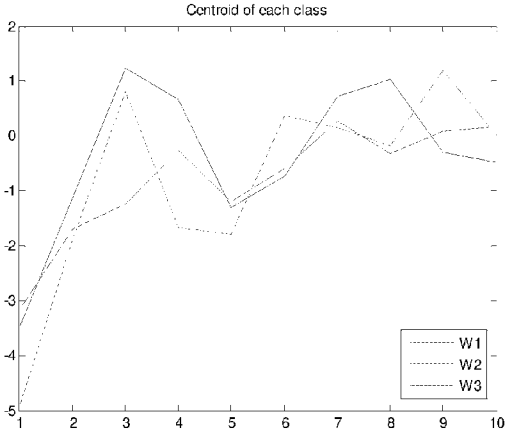

The "draw attention cry words," "diaper change needed cry words," and "hungry cry words" MFCC-10 features of 4 different babies are illustrated in FIGS. 12A-C, respectively. After numerous (e.g., 300) iterations, the value of weights vectors $W_1$, $W_2$, $W_3$ which present the centroid of each different cause class are fixed, and the centroid curves of each class are shown in FIG. 12D.

In another embodiment, linear predictive coding (LPC) may be utilized to obtain baby cry characteristics. In certain cases, the waveforms of two similar sounds will also show similar characteristics. If two infant cries have very similar waveforms, it stands to reason that they should possess the same impetus. However, it is impractical to conduct a sample by sample full comparison between cry signals due to the complexity inherent in having audio signals of around 1 second in length at a sampling rate of 8 kHz. In order to improve the solution of the time domain comparison of infant cry signals, linear predictive coding (LPC) is applied.

As mentioned previously, there may be two acoustic sources associated with voiced and unvoiced speech, respectively. Voiced speech is caused by the vibration of the vocal cords in response to airflow from the lung and this vibration is periodic in nature while unvoiced speech is caused by constrictions in the air tract resulting in random airflow. The basis of the source-filter model of speech is that speech can be synthesized by generating an acoustic source and passing it through an all-pole filter. The linear predictive coding (LPC) algorithm produces a vector of coefficients that represent a spectral shaping filter. An input signal to this filter is either a pitch train for voiced sounds, or white noise for unvoiced sounds. This shaping filter may be an all-pole filter represented as:

$$H(z) = \frac{1}{1 - \sum_{i=1}^{M} a_i z^{-i}},$$

where $\{a_i\}$ are the linear prediction coefficients and M is the number of poles (the roots of the denominators in the z transform). A present sample of speech may be represented as a linear combination of the past M samples of the speech such that:

$$\hat{x}(n) = a_1 x(n-1) + a_2 x(n-2) + \ldots + a_M x(n-M) = \sum_{i=1}^{M} a_i x(n-i),$$

where $\hat{x}(n)$ is the predicted value of x(n).

The error between the actual and predicted signal can be defined as $$\varepsilon(n) = x(n) - \hat{x}(n) = x(n) - \sum_{i=1}^{M} a_i x(n-i).$$

The smaller the error, the better the spectral shaping filter is at synthesizing the appropriate signal. Taking the derivative of the above equation with respect to $a_i$ and equating to 0 yields:

$$\langle \varepsilon(n), x(n) \rangle = \sum_{i=1}^{M} e[n]x[n-1] = 0$$

Minimization of error yields sets of linear equations in the form of the error between the actual and predicted signal, expressed above. To obtain the minimum mean square error, an autocorrelation method where the minimum is found by applying the principle of orthogonality as the predictor coefficients that minimize the prediction error must be orthogonal to the past vectors.

$$R = \begin{bmatrix} R(0) & R(1) & \ldots & R(n-1) \\ R(1) & R(0) & \ddots & \vdots \\ \vdots & \ddots & \ddots & \vdots \\ R(n-1) & \ldots & \ldots & R(0) \end{bmatrix}$$

This can be achieved by using a Toeplitz autocorrelation matrix R to find the LPC parameters and using the Levinson-Durbin recursion to solve the Toeplitz matrix.

Effectively, the purpose of LPCC is to take a waveform of a large size in unit samples and then compress it into a more manageable form. Because similar waveforms should also result in similar acoustic output, LPC serves as a time domain measure of how close two different waveforms are.

Because of the sampling rate of 8 kHz and the generalization that f/1000+2 LPC coefficients are the minimum required to decompose a waveform, 10 LPCC or LPC-10 may be used to describe each 128 sample frame which corresponds to 16 ms and is assumed to be short-time stationary. Instead of computing the difference between windowed segments of 128 samples in length, only comparisons of segments of the LPC-10 values are needed. Furthermore, during signal preprocessing, a first order low pass filter can be used to brighten the signal such that components due to non-vocal tract speech can be attenuated.

In another embodiment, cepstrum analysis may be used to obtain baby cry characteristics. To obtain the frequency spectrum F(w), a Fourier transform, denoted by F{ }, must be performed on the time domain signal f(t) as F(w)=F{f(t)}.

However, it is possible to take the Fourier transform of the log spectrum as if it were a signal as well. The result of this transformation moves one from the frequency spectrum domain to the power cepstrum domain described by $$|F\{\log(|F\{f(t)\}|^2)\}|^2.$$

The cepstrum provides information about the rate of change in the different spectrum bands. This attribute can be exploited as a pitch detector. For example, if the sampling rate of a cry signal is 8 kHz and there is a large peak in the spectrum where the quefrency (x-axis frequency analog in spectrum domain) is 20 samples, the peak indicates the existence of a pitch of 8000/20=400 hz. This peak occurs in the cepstrum because the harmonics in the spectrum are periodic, and the period corresponds to the pitch.

Cepstrum pitch determination is particularly effective because the effects of the vocal excitation (pitch) and vocal tract (formants) are additive in the logarithm of the power spectrum and thus clearly separate. This trait makes cepstrum analysis of audio signals more robust than processing normal frequency or time domain samples. Another technique used to improve the accuracy of feature extraction of cepstrum based techniques is liftering. Liftering applies a low order low pass filter to the cepstrum in order to smooth it out and help with the Discrete Cosine Transform (DCT) analysis for feature extraction techniques in ensuing sections. Additionally, linear predictive cepstral coefficients (LPCC) may be used for audio feature extraction. LPCCs may be obtained by applying linear predictive coding on the cepstrum. As mentioned above, the cepstrum is a measure of the rate of change in spectrum bands over windowed segments of individual cries. Applying LPC to the cepstrum yields a vector of values for a 10-tap filter that would synthesize the cepstrum wave form.

Similar to the MFCC, the bark frequency cepstral coefficients (BFCC) warps the power cepstrum such that it matches human perception of loudness. The methodology of obtaining the BFCC is similar to that of the MFCC except for two differences. The frequencies are converted to bark scale according to:

$$b = 13\tan^{-1}(.00076f) + 3.5\tan^{-1}\left[\left(\frac{f}{7500}\right)^2\right],$$

where b denotes bark frequency and f is frequency in hertz. The mapped bark frequency is passed through a plurality (e.g., 18) of triangle band pass filters. The center frequencies of these triangular band pass filters correspond to the first 18 of the 24 critical frequency bands of hearing (where the band edges are at 20, 100, 200, 300, 400, 510, 630, 770, 920, 1080, 1270, 1480, 1720, 2000, 2320, 2700, 3150, 3700, 4400, 5300, 6400, 7700, 9500, 12000 and 15500 Hz). This is done because frequencies above 4 kHz may be attenuated by the low pass anti-aliasing filter described in signal preprocessing. This also allows for a more comparable comparison between the MFLPCC and BFLPCC later on.

The BFCC is obtained by taking the DCT of the bark frequency cepstrum and the 10 DCT coefficients describe the amplitudes of the cepstrum. The power cepstrum also possesses the same sampling rate as the signal, so the BFLPCC is obtained by performing the LPC algorithm on the power cepstrum in 128 sample frames. The BFLPCC encodes the cepstrum waveform in a more compact fashion that may make it more suitable for a baby-cry classification scheme.

In another exemplary embodiment, Kalman filters may be utilized for baby voice feature extraction. One characteristic of analog generated sources of noise is that no two signals are identical. As similar as two sounds may be, they will inherently vary to some degree in pitch, volume and intonation. Regardless, it can be said that adjoining infant cries are highly similar and most likely have the same meaning. In order to estimate the true cry from the recorded cries, Kalman filter formulation may be used.

If x(n) is arranged as an AR(p) (auto-regressive process of order p), it may be generated according to $$x(n) = \sum_{k=1}^{p} a(k)x(n-k) + w(n). \tag{A}$$

Supposing that x(n) is measured in the presence of additive noise, then $$y(n)=x(n)+v(n) \tag{B}$$

If we let x(n) be the p-dimensional state vector $$x(n) = \begin{bmatrix} x(n) \\ x(n-1) \\ \vdots \\ x(n-p+1) \end{bmatrix}$$

then (A) and (B) can be expressed in terms of x(n) as $$x(n) = \begin{bmatrix} a(1) & a(2) & \dots & a(p-1) & a(p) \\ 1 & 0 & \dots & 0 & 0 \\ 0 & 1 & \dots & 0 & 0 \\ \vdots & \vdots & \dots & & \vdots \\ 0 & 0 & \dots & 1 & 0 \end{bmatrix} x(n-1) + \begin{bmatrix} 1 \\ 0 \\ 0 \\ \vdots \\ 0 \end{bmatrix} w(n) \tag{C}$$

and $$y(n) = [1, 0, \dots, 0]x(n) + v(n) \tag{D}$$

Equations (C) and (D) can be simplified using matrix notation:

$$x(n)=Ax(n-1)+w(n)$$

$$y(n)=c^T x(n)+v(n) \tag{E}$$

where A is a p×p state transition matrix, w(n)=[w(n), 0, . . . , 0]$^T$ is a vector noise process and c is a unit vector of length p. Even though it is applicable primarily in stationary AR(p) processes, (D) can be generalized to a non-stationary process by letting x(n) be a state vector of dimension p that evolves according to the difference equation $$x(n)=A(n-1)x(n-1)+w(n)$$

where A(n−1) is a time varying p×p state transition matrix and w(n) is a vector of zero-mean white noise processes and let y(n) be a vector of observations that are formed according to $$y(n)=C(n)x(n)+v(n)$$

where y(n) is a vector of length q, C(n) is a time varying q×p matrix and v(n) is a vector of zero mean white noise processes that are statistically independent of w(n).

It can be appreciated by those skilled in the art that the present disclosure provides innovative systems, apparatuses and methods for electronic devices that integrate active noise control (ANC) techniques for abating environmental noises, with a communication system that communicates to and from an infant. Such configurations may be advantageously used for infant incubators, hospital beds, and the like. The wireless communication system can also provide communication between infants to their parents/caregivers/nurses, patients/family members/nurses/physicians, and also provide intelligent digital monitoring hat provide non-invasive detection and classification of infant's audio signals/other audio signals.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An enclosure, comprising:

a noise cancellation portion, comprising a controller unit, operatively coupled to one or more error microphones and a reference sensing unit, wherein the controller unit processes signals received from one or more error microphones and reference sensing unit to reduce noise in an area within the enclosure using one or more speakers; and an external voice input apparatus operatively coupled to the noise cancellation portion, wherein the external voice input apparatus is configured to receive external voice signals and reproduce the external voice signals on the one or more speakers, wherein the external voice signals are external to the area within the enclosure, wherein the external voice input apparatus comprises a sound analyzer configured to analyze the external voice signals and determine whether the external voice signals are desired speech signals.

2. The enclosure of claim 1, wherein the desired speech signals are a parent's voice.

3. The enclosure of claim 1, wherein the external voice input apparatus further comprises a transmitter and wherein the controller unit reproduces the desired speech signals using the one or more speakers.

4. The enclosure of claim 3, wherein the reference sensing unit includes a microphone for receiving the external voice signals.

5. The enclosure of claim 4, wherein the microphone is a wireless microphone that is not placed on or within the enclosure.

6. The enclosure of claim 1, wherein the external voice input apparatus is further configured to receive an interior audio signal, wherein the interior audio signal originates inside the enclosure.

7. The enclosure of claim 6, wherein the controller unit of the enclosure, based on the interior audio signal, detects an emergency noise.

8. The enclosure of claim 7, further comprising a transmitter;

wherein the enclosure, in response to the emergency noise, sends an emergency message via the transmitter.

9. An incubator for reducing unwanted noises and reproducing desired voice signals, the incubator comprising:

an interior space within the incubator;

a noise reduction portion, comprising:

one or more speakers;

an error microphone;

a reference sensing unit; and a controller unit operatively coupled to the error microphone and the reference sensing unit, wherein the controller unit processes signals received from the error microphone and the reference sensing unit to reduce unwanted noise in the interior space using one or more speakers; and a communication portion configured to reproduce a desired voice signal within the interior space, wherein the communication portion is operatively coupled to the noise reduction portion and wherein the desired voice signal originates outside of the incubator;

wherein the communication portion comprises a receiver configured to receive an external audio signal;

wherein the external audio signal originates outside of the incubator; and wherein the communication portion comprises a sound analyzer configured to analyze the external audio signal and determine whether the external audio signal is the desired voice signal.

10. The incubator of claim 9, wherein the desired voice signal is a parent's voice.

11. The incubator of claim 9, wherein the communication portion further comprises a transmitter that transmits the desired voice signal to the controller unit, and wherein the controller unit reproduces the desired voice signal using the one or more speakers.

12. The incubator of claim 11, wherein the reference sensing unit includes a microphone for receiving an audio signal.

13. The incubator of claim 12, wherein the microphone is a wireless microphone that is not placed on or within the incubator.

14. The incubator of claim 9, wherein the communication portion is further configured to receive an interior audio signal, wherein the interior audio signal originates inside the incubator.

15. The incubator of claim 14, wherein the controller unit of the incubator, based on the interior audio signal, detects an emergency noise.

16. The incubator of claim 15, further comprising a transmitter; and wherein the incubator, in response to the emergency noise, sends an emergency message via the transmitter.

* * * * *